US007280790B2

(12) United States Patent
Watanabe et al.

(10) Patent No.: US 7,280,790 B2
(45) Date of Patent: Oct. 9, 2007

(54) IMAGE FORMING APPARATUS

(75) Inventors: Koichi Watanabe, Kanagawa (JP); Shinichi Kuramoto, Kanagawa (JP); Mitsuo Yamamoto, Kanagawa (JP); Shuich Nishide, Kanagawa (JP); Wataru Suzuki, Kanagawa (JP); Masahiro Sato, Kanagawa (JP); Atsuyuki Kitamura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 109 days.

(21) Appl. No.: 10/938,782

(22) Filed: Sep. 13, 2004

(65) Prior Publication Data

US 2006/0056883 A1 Mar. 16, 2006

(51) Int. Cl.
*G03G 15/01* (2006.01)

(52) U.S. Cl. ..... 399/302; 399/66

(58) Field of Classification Search ..... 399/302, 399/66, 82, 85

See application file for complete search history.

(56) References Cited

U.S. PATENT DOCUMENTS 6,603,945 B2 * 8/2003 Amarakoon et al. ..... 399/309
2003/0108368 A1 * 6/2003 Omata et al. ..... 399/309
2004/0086306 A1 * 5/2004 Edahiro et al. ..... 399/328

FOREIGN PATENT DOCUMENTS

JP 61099171 A * 5/1986
JP A-02-212870 8/1990
JP 08166732 A * 6/1996

* cited by examiner

*Primary Examiner*—David M. Gray
*Assistant Examiner*—Erika J. Villaluna
(74) *Attorney, Agent, or Firm*—Morgan, Lewis & Bockiuss LLP

(57) ABSTRACT

An image forming apparatus has an image forming carrier, an image forming portion that forms an image on the image forming carrier, an intermediate transfer medium to which the image on the image forming carrier is primarily transferred, and a transfer portion that secondarily transfers to a recording medium the image primarily transferred to the intermediate transfer medium. An area where the image forming carrier and the intermediate transfer medium are opposed includes a primary transfer area where the image on the image forming carrier is transferred to the intermediate transfer medium and a secondary transfer area where the image on the intermediate transfer medium is transferred to the recording medium.

32 Claims, 18 Drawing Sheets

MONOCLUROMATIC MODE

COLOR MODE 1 (PLAIN PAPER)

COLOR MODE 2 (OHP PAPER)

IMAGE FORMING APPARATUS

BACKGROUND OF THE INVENTION

1. Field of the Invention

The invention relates to an image forming apparatus such as copying machines, printers and facsimile machines, and more particularly to an image forming apparatus of an intermediate transfer type for transferring an image formed on an image forming carrier to a recording medium via an intermediate transfer medium.

2. Description of the Related Art

There is a known image forming apparatus (e.g., JP-A-2-212870) as a related-art image forming apparatus of the intermediate transfer type, which has been provided with developing units for yellow (Y), magenta (M), cyan (C) and black (B) color components, for example, around an image forming carrier such as a photosensitive drum and an intermediate transfer medium in the form of a belt (intermediate transfer belt), for example, disposed opposite to the image forming carrier. The conventional image forming apparatus above is used for forming a desired image on paper by making the primary transfer of unfixed toner images with various color components formed on the image forming carrier per rotation of the image forming carrier sequentially to the intermediate transfer belt and also makes the secondary transfer of a composite primarily-transferred image laid on top of each other on the intermediate transfer belt on the paper as a recording medium.

In this case, a secondary transfer device is employed, having, for example, a transfer roll so disposed as to be in contact with the intermediate transfer belt, a backup roll disposed opposite to the transfer roll with the intermediate transfer belt held therebetween, and a power supply for applying bias between the transfer roll and the backup roll for forming an electric field causing the toner images on the intermediate transfer belt to be transferred on the paper.

As the composite primarily-transferred image that has already been subjected to multiplex transfer on the intermediate transfer belt is collectively transferred on the paper, the image forming apparatus of the intermediate transfer type is advantageous in that unstable factors at the time of forming images become removable and that generation of image disorders and color drift can effectively be prevented at the time of the multiplex transfer.

In the above image forming apparatus of the intermediate transfer type, however, since the secondary transfer device provided separately from a primary transfer device is indispensable, a relatively high-cost functional member (transfer roll) has to be disposed on the periphery of the intermediate transfer medium, which tends to increase not only space for the exclusive use of the secondary transfer device but also the number of parts, thus resulting in increasing the size of the image forming apparatus itself as well as costs.

SUMMARY OF THE INVENTION

The object of the invention is to provide an image forming apparatus for making stably available images of good quality with an attempt to achieve not only a reduction of cost of the apparatus itself but also a reduction in the size and space-saving but also.

The invention provides, as shown in FIG. 1A, an image forming apparatus having: an image forming carrier 1; an image forming portion 2 that forms an image G on the image forming carrier 1; an intermediate transfer medium 3 to which the image G on the image forming carrier 1 is primarily transferred; and a transfer portion 4 that secondarily transfers to a recording medium 5 the image G primarily transferred to the intermediate transfer medium 3, wherein an area where the image forming carrier 1 and the intermediate transfer medium 3 are opposed includes a primary transfer area m1 where the image G on the image forming carrier 1 is transferred to the intermediate transfer medium 3 and a secondary transfer area m2 where the image G on the intermediate transfer medium 3 is transferred to the recording medium 5.

In the image forming apparatus, in a color mode, for example, the image forming portion 2 sequentially forms the images G with various color components on the image forming carrier 1, and the transfer portion 4 (for use in a primary transfer cycle) sequentially subjects the images G with the respective color components on the image forming carrier 1 to a primary transfer to the intermediate transfer medium 3, as shown in FIG. 1A and FIG. 1B. As shown in FIG. 1C, further, the transfer portion 4 (for use in a secondary transfer cycle) subjects the primarily transferred image G on the intermediate transfer medium 3 to a secondary transfer to the recording medium 5.

The image forming carrier 1 may be provided one or more. The transfer portion 4 enables to perform in any one of an indirect transfer mode in which the image G on the intermediate transfer medium 3 is secondarily transferred to the recording medium 5 and a direct transfer mode in which the image G on the image forming carrier 1 is directly transferred to the recording medium 5.

The image forming carrier 1 and the intermediate transfer medium 3 may be in the form of either drum or belt, but it is preferable that any one of the intermediate transfer medium 3 and the image forming carrier 1 is an endless belt.

Moreover, any kind of image forming method such as an electrophotographic method, an electrostatic recording method, an ink-jet method or the like may be employed for the image forming portion 2 and with respect to image formation, both monochromatic and color (e.g., two-color and full-color) images are included.

With any of the intermediate transfer medium 3 and image forming carrier 1 being in the form of an endless belt (in FIG. 1, the intermediate transfer medium 3 is a belt member), the required volume of an image forming apparatus can be made smaller.

In addition, the freedom of contact width between the image forming carrier 1 and the intermediate transfer medium 3 is increased, which makes it feasible to secure relatively greater contact width. As relatively greater contact width is secured, a transfer electric field becomes applicable within this contact width range, so that a stable electric field is formed. In this case, further, the electric field generated in an air gap at both ends of the contact area between the image forming carrier 1 and the intermediate transfer medium 3 can be decreased, the air gap portions are less affected by the electric field.

In the case that any one of the image forming carrier 1 and intermediate transfer medium 3 is the endless belt (the intermediate transfer medium 3 is in the form of a beltlike member in FIG. 1A-FIG. 1C), a contact width of the image forming carrier 1 with the intermediate transfer medium 3 is desirably equal to or longer than a perimeter of a tension roll 3*a* having the smallest diameter among tension rolls 3*a* stretching the belt.

By utilizing the fact that a minute speed cycle generated in the intermediate transfer medium 3 due to the eccentricity of the tension rolls 3*a*, the minute fluctuation cycle of the peripheral speed (to be exact, the relative speed between the image forming carrier 1 and the intermediate transfer medium 3) of the intermediate transfer medium 3 is caused to act by not less than one cycle on the contact area between the intermediate transfer medium 3 and the image forming carrier 1, whereby the effect of mechanical shear force is obtainable in such a condition that no defect such as a shear in imaging is generated.

Therefore, good transfer efficiency is attainable with a high level of banding and out-of-color-registration performance secured.

In the case that any one of the image forming carrier 1 and intermediate transfer medium 3 is the endless belt, the belt preferably has elasticity.

In this case, an image omission due to a pressure increase in the transfer portion is preventable.

Moreover, it is only needed for the primary transfer area m1 and the secondary transfer area m2 to be set in an area where the image forming carrier 1 and the intermediate transfer medium 3 are placed opposite to each other.

In this case, the meaning of "an area where the image forming carrier 1 and the intermediate transfer medium 3 are placed opposite to each other" is that the primary transfer area m1 and the secondary transfer area m2 are not limited to existing in the same area but include being contiguous to each other.

The "transfer portion 4" is provided in the opposite area and includes what is commonly used in a broad sense with respect to the primary transfer and the secondary transfer; namely, one proper transfer device or a plurality of proper transfer devices may be selected in a switchable fashion.

The transfer portion 4 preferably changes a transfer condition according to an image forming mode or type of the recording medium 5.

By changing the transfer conditions, the transfer conditions can be optimized in accordance with a image forming mode and type of the recording medium 5.

The "changes of transfer conditions" broadly include changing the transfer bias and the transfer current, changing the condition of which one of the transfer devices is used, changing the condition of whether the primary transfer is carried out in the image forming cycle and so forth.

In an image forming apparatus capable of executing a monochromatic mode and the color mode, the transfer portion 4 is only required to directly transfer the image on the image forming carrier 1 to the recording medium 5 without primarily transferring to the intermediate transfer medium 3 in the monochromatic mode.

In this case, as the primary transfer process can be dispensed with, the image forming time in the monochromatic mode is shortened.

The relation between the primary transfer condition and the secondary transfer condition is such that when the transfer portion 4 is used, the primary transfer condition is preferably different from the secondary transfer condition.

In this case, the image transfer direction with respect to the primary transfer and the secondary transfer is reversed and as an object on which the transfer electric field acts is also different, the transfer conditions are required to be different from each other in principle.

In the case there exists a pressure condition satisfying both the primary transfer and secondary transfer in the pressurizing transfer method, however, the same condition can be applied to both.

A representative different transfer condition is that a primary transfer electric field is opposite in polarity to a secondary transfer electric field.

In this case, as the image transfer directions are oriented opposite to each other with respect to the primary transfer and the secondary transfer, the polarity of the transfer electric field needs reversing.

The concrete mode of reversing the polarity may properly be selected by using one positive-to-negative switchable power supply unit or a plurality of switchable power supply units.

Another representative different transfer condition is that a transfer speed (equivalent to process speed) at the primary transfer is different from a transfer speed at the secondary transfer.

In this case, transfer of high image quality is made possible by lowering the transfer speed when thick paper and OHP sheets are used as the recording medium 5, for example.

Further, by gripping the invention from a different point of view, the invention is considered as an image forming apparatus that can be graded up from a monochromatic (e.g., black-and-white) machine to a color machine.

In this case, as shown in FIG. 2A and FIG. 2B, the image forming apparatus is separable to a basic unit 6 (see FIG. 2A) for a monochromatic image formation and an optional unit 7 (see FIG. 2B) provided by adding to the basic unit 6 or replacing a part of the basic unit 6.

In this case, a proper method of separating the optional unit 7 from the basic unit 6 may be selected.

As an example of the separating method above, the basic unit 6 involves the image forming carrier 1, the image forming portion 2 and the transfer portion 4, the optional unit 7 involves an optional sub-unit 7*a* which enables to be provided by adding to the image forming portion 2 and is required for a color image formation and an optional intermediate transfer medium 7*b* which enables to be provided by adding between the image forming carrier 1 and the transfer portion 4, and the transfer portion 4 secondarily transfers to the recording medium 5 the image G transferred to the optional intermediate transfer medium 7 after the image G on the image forming carrier 1 is primarily transferred to the optional intermediate transfer medium 7*b* (the intermediate transfer body 3).

In addition, there are modes wherein only the optional sub-unit 7*a* is added with the intermediate transfer medium 3 incorporated as the basic unit 6; "optional sub-unit 7*a*+optional intermediate transfer medium 7*b*+optional transfer portion (replacement of the transfer portion)" (on the assumption that the transfer portion is incorporated in an intermediate transfer medium unit beforehand); and so forth.

The image forming apparatus may further has a first reversing portion that inverts the recording medium 5 before the recording medium 5 passes through the primary transfer area m1 and the secondary transfer area m2, wherein the first reversing portion inverts the recording medium 5 in the indirect transfer mode. Consequently, the recording medium 5 is guided to a transfer region with the recording medium turned upside down in the indirect transfer mode as compared with the direct transfer mode.

The image forming apparatus may further has a second reversing portion that inverts the recording medium 5 after the recording medium 5 passes through the primary transfer area m1 and the secondary transfer area m2, the second reversing portion inverts the recording medium 5 in the indirect transfer mode. Consequently, the recording medium 5 can be discharged with the printing side oriented in the same direction as the direction in the direct transfer mode even though the image has been transferred to the recording medium 5 with the recording medium 5 turned upside down.

In this case, the recording medium 5 can be discharged with the printing side oriented in the same direction even though the image transfer side is turned upside down in the image forming apparatus. Therefore, printing can be carried out on the desired side of the recording medium 5, irrespective of the image forming mode.

The image forming apparatus may further has a first fixing portion involving a heat roll which heats the recording medium 5 and a pinch roll that rotatably holds the recording medium 5 with the heat roll, wherein the image transferred to the recording medium 5 is fixed to the recording medium 5 by heat from the heat roll; and a third reversing portion that inverts the first fixing portion so that positions of the heat roll and the pinch roll with respect to a surface of the recording medium 5 become inverted, wherein the third reversing portion inverts the first fixing portion so that an image transfer side of the recording medium 5 abuts on the heat roll. In this case, even though the image transfer side is turned upside down, the transfer side comes into contact with the heat roll. Therefore, it is ensured that the image can be fixed to the recording medium 5, irrespective of the image forming mode.

The image forming apparatus may further has a second fixing portion that fixes the image transferred to the recording medium 5 to the recording medium by heat from the heat roll; a guide portion that guides the recording medium 5, whose state is before that the transferred image is fixed, to the second fixing portion; and a guide direction switching portion that switches a direction of the guide portion toward the recording medium 5, wherein the guide direction switching portion directs the guide portion toward a side of the recording medium 5 which no image is transferred. In this case, even though the image transfer side in the image forming apparatus is turned upside down in the image forming mode, the toner image before fixation is never disturbed.

The image forming apparatus may further has: a third fixing portion involving a first heat roll and a second heat roll which enables to heat the recording medium 5, wherein the first heat roll and the second heat roll rotatably hold the recording medium 5 so that the image transferred to the recording medium 5 is fixed to the recording medium by heat from the first heat roll or the second heat roll. Further, the third fixing portion may fix the image transferred to the recording medium to the recording medium by heat from a heat roll abutting on a side of the recording medium to which an image is transferred. In this case, even though the image transfer side is turned upside down, the transfer side of the recording medium 5 comes into contact with the heat roll on the transfer side. Therefore, it is ensured that the image can be fixed to the recording medium 5, irrespective of the image forming mode.

The third fixing portion may cause the first heat roll and the second heat roll to generate heat during a warm-up. In this case, the warm-up time can be shortened. Further, the third fixing portion may fix the image to the recording medium by heat from the first heat roll and the second heat roll. In this case, it is also ensured that the transfer process can be performed even though the recording medium 5 is thick paper.

DETAILED DESCRIPTION OF THE PREFERRED EMBODIMENTS

A detailed description of embodiments of the invention will now be given by reference to the drawings.

First Embodiment

Figure 1A:
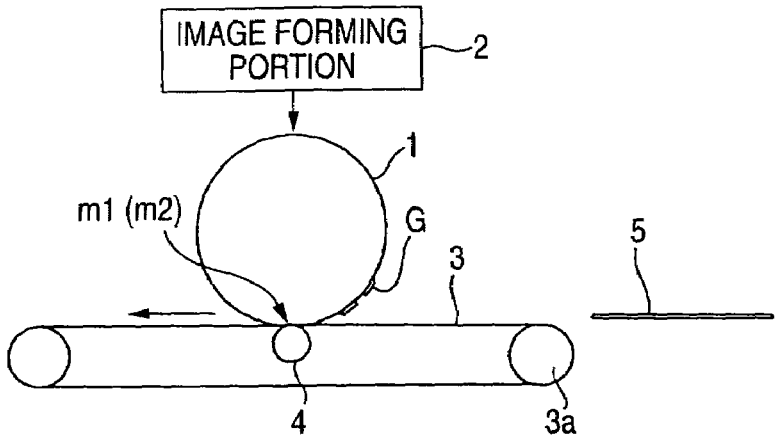
FIG. 1A is a schematic illustration of an image forming apparatus according to the invention.
Figure 1B:
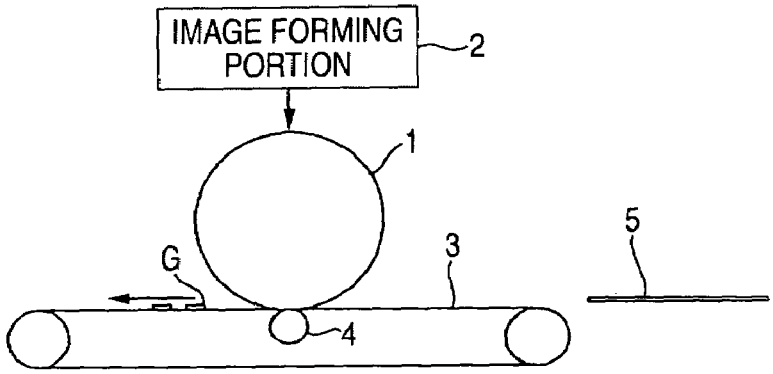
FIG. 1B and FIG. 1C are illustrative of an image forming process performed by the image forming apparatus.
Figure 1C:
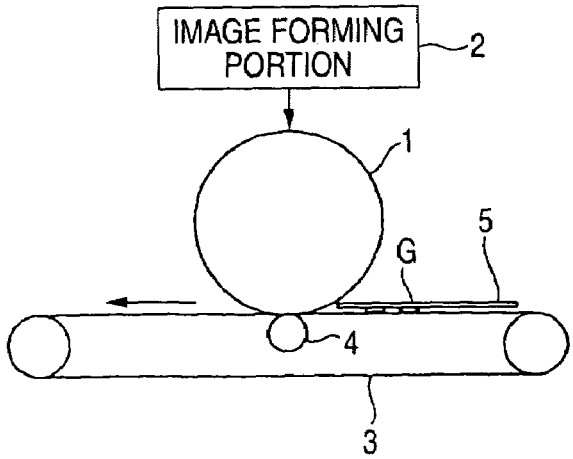
Figure 2A:
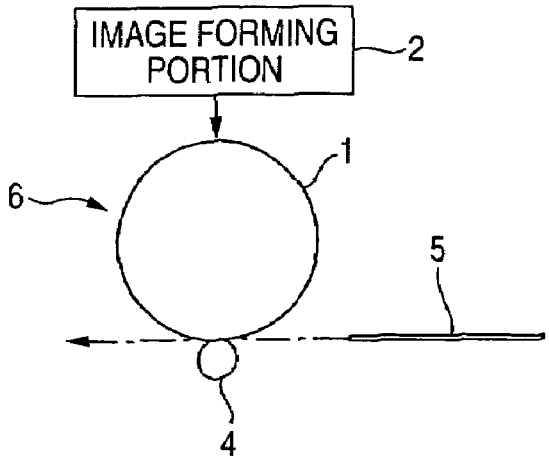
FIG. 2A is illustrative of a basic unit in the image forming apparatus according to the invention.
Figure 2B:
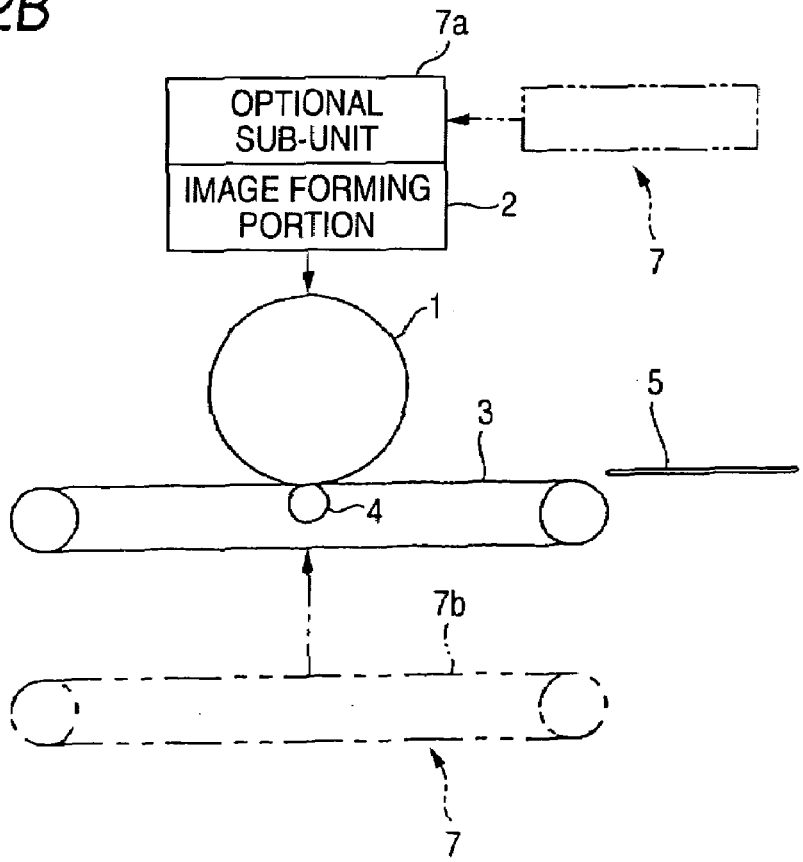
FIG. 2B is illustrative of an exemplary configuration of "basic unit+an optional unit" in the image forming apparatus according to the invention.
Figure 3:
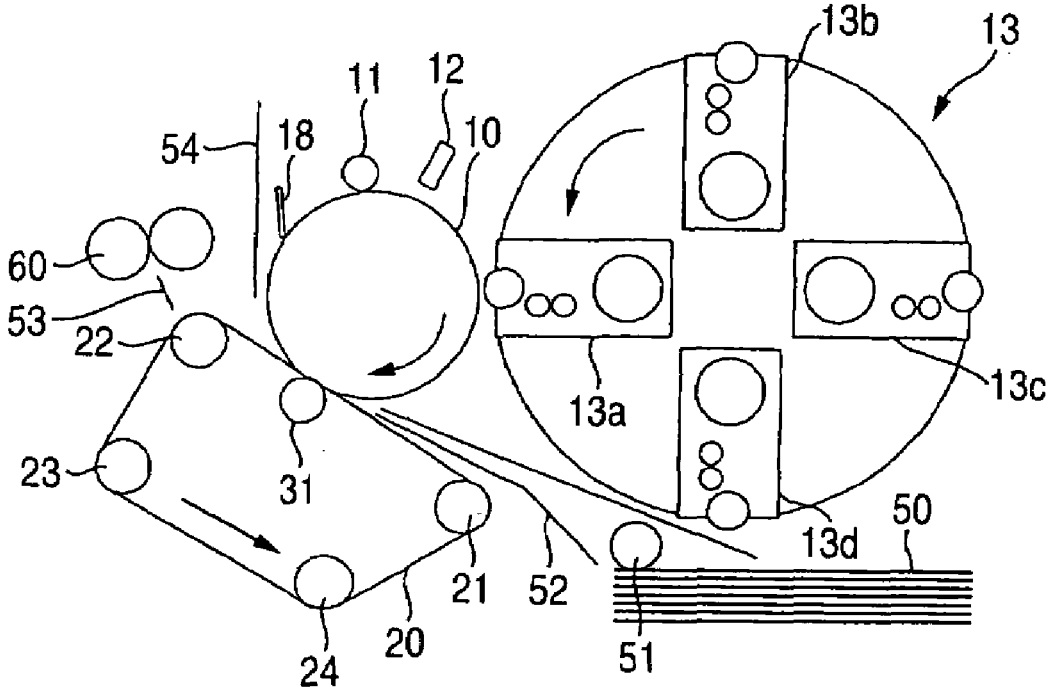
FIG. 3 shows the overall configuration of an image forming apparatus according to a first embodiment of the invention.

FIG. 3 shows the overall configuration of an image forming apparatus according to a first embodiment of the invention.

The image forming apparatus of FIG. 3 is of an intermediate transfer type and has a photosensitive drum 10 and an intermediate transfer belt 20 so disposed as to be in contact with the photosensitive drum 10.

According to this embodiment, the photosensitive drum 10 is provided with a photosensitive layer whose resistance value is lowered by light irradiation. Around the photosensitive drum 10, the following are provided in predetermined locations: a charging device 11 for electrically charging the photosensitive drum 10, an exposure device 12 for writing electrostatic latent images with various color components (black, yellow, magenta and cyan in this example) to the photosensitive drum 10 thus electrically charged, a rotary developing device 13 for converting the latent images with the respective color components formed on the photosensitive drum 10 into visible images with toner having corresponding color components, the intermediate transfer belt 20, and a cleaner 18 for cleaning out the residual toner on the photosensitive drum 10.

Although a charging roll, for example, is employed as the charging device 11, use can be made of a charger such as a corotron charger.

The exposure device 12 is only required to write images to the photosensitive drum 10 by means of light and though a print head using LED, for example, is employed for the purpose according to this embodiment of the invention, the exposure device 12 is not limited to such a print head as mentioned above but a print head using EL or otherwise a scanner for performing scanning with a laser beam via a polygon mirror may properly be selected.

Further, the rotary developing device 13 carries rotatable developing units 13*a*-13*d* containing toner with various color components and any other proper unit of such equipment may be selected as long as it makes each color component toner stick to a portion where electrical potential is lowered by exposure on the photosensitive drum 10, for example, and toner for use is not particularly restricted in particle shape and size but may be any proper one as long as it is accurately put on an electrostatic latent image on the photosensitive drum 10. Although the rotary developing device 13 is employed according to this embodiment of the invention, four of the developing units may be disposed in parallel.

With respect to the cleaner 18, any proper one employing a blade cleaning method may be selected as long as it cleans out the residual toner on the photosensitive drum 10. In case where a high-transfer-rate toner is used, however, it is possible to adopt a mode of dispensing with such a cleaner 18.

The intermediate transfer belt 20 may be made of resins or rubber. In the embodiment, a resin material such as polyimide or polycarbonate resin is used.

The intermediate transfer belt 20 requires a volume resistivity (of e.g., $10^6$-$10^{12}$ Ω·cm) to maintain transfer performance and when the cleanability of the surface of the intermediate transfer belt is taken into consideration, a mold release layer is preferably provided on the surface.

As the intermediate transfer belt 20 is laid in a tensioned condition over a plurality (e.g., four) of tension rolls 21-24; the tension roll 21 positioned on the upstream side of the transfer position out of the four tension rolls 21-24 functions as a driving roll, for example, whereas the tensions rolls 22, 23 and 24 positioned on the downstream side thereof function as driven rolls according to this embodiment of the invention.

Further, a transfer roll 31 as a transfer member is so disposed as to be in contact with the back side of the intermediate transfer belt 20 and a power supply unit 40 (see FIGS. 4A and 4B) is connected to the transfer roll 31, so that a primary transfer bias or a secondary transfer bias is selectively applied.

In this case, the transfer roll 31 is a roll made of elastic conductive member: for example, foamed urethane, foamed acryl, foamed silicon or the like.

As conductivity is required to provide a transfer charge, a volume resistivity of not greater than $10^6$ Ω·cm is preferred. In view of providing a stable electric charge and a stable pressing force at the time of transfer, the nip width has to be as wide as possible and use of an elastic body is preferred in this sense. The roll diameter is 10 mm or greater and 30 mm or smaller at least, for example, and preferably 12 mm or greater and 20 mm or smaller.

As the primary transfer makes it necessary to transfer the toner on the photosensitive drum 10 toward the intermediate transfer belt 20, voltage opposite in polarity to the toner is employed as the primary transfer bias applied to the transfer roll 31. On the other hand, as the secondary transfer makes it necessary to transfer the toner on the intermediate transfer belt 20 toward a recording medium 50, voltage equal in polarity to the toner is employed as the secondary transfer bias applied to the transfer roll 31.

Further, the position where the transfer roll 31 is disposed may be any position where the primary transfer is possible as before and is not particularly restricted.

Figure 4A:
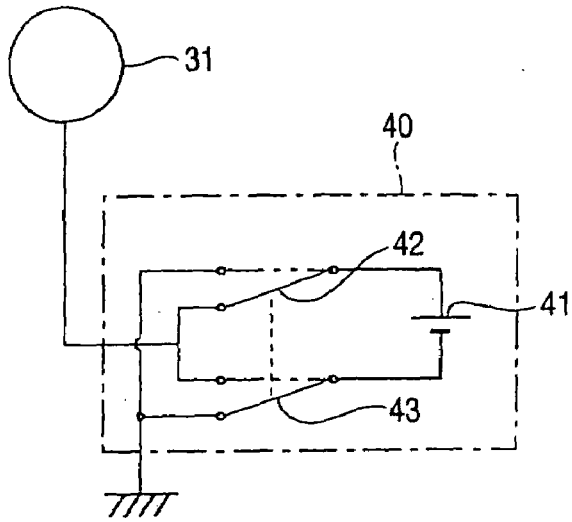
FIG. 4A shows an exemplary arrangement of a power supply unit for use in a transfer device.

As shown in FIG. 4A, for example, the power supply unit 40 for use is so configured as to have one power supply 41 and two switching elements 42 and 43 for selectively switching between the positive and negative states.

The switching elements 42 and 43 in this case are used to switch between the positive and negative states of the power supply 41 in response to an image-forming cycle, for example, and operate so that a positive transfer bias is applied at the time of the primary transfer and a negative transfer bias is applied at the time of the secondary transfer.

Figure 4B:
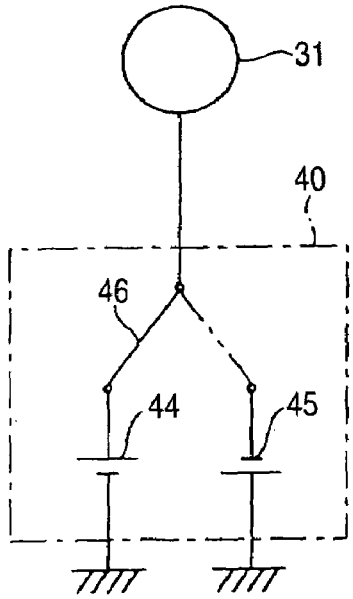
FIG. 4B shows another exemplary configuration of the power supply unit.

The power supply unit 40 in another mode, as shown in FIG. 4B, for example, has two power supplies 44 and 45 different in polarity and a switching element 46 for selectively switching between the power supplies 44 and 45 whereby to apply the positive transfer bias of the power supply 44 on one side at the time of the primary transfer and the negative transfer bias of the power supply 45 on the other side at the time of the secondary transfer.

With respect to the primary transfer bias and the secondary transfer bias, all proper ones may be selected on condition that they are different in polarity; however, it is preferred to set the absolute value level of the secondary transfer bias higher than that of the primary transfer bias because the resistance of paper as a recording medium 50 is higher than that of the intermediate transfer belt 20 by any number of powers.

As the recording medium 50 such as paper is stored in a feed tray (not shown), the recording medium 50 is led to an opposite portion (transfer region) to the photosensitive drum 10 and to the intermediate transfer belt 20 after being supplied by a feed roll 51 and then conveyed to a fixing device 60. Reference numeral 52 in FIG. 3 denotes a guide chute for guiding the recording medium 50 to the transfer region; 53, a guide plate for guiding the recording medium 50 on the intermediate transfer belt 20 to the fixing device 60; and 54, a shield plate for shutting off the heat of the fixing device 60.

Figure 5:
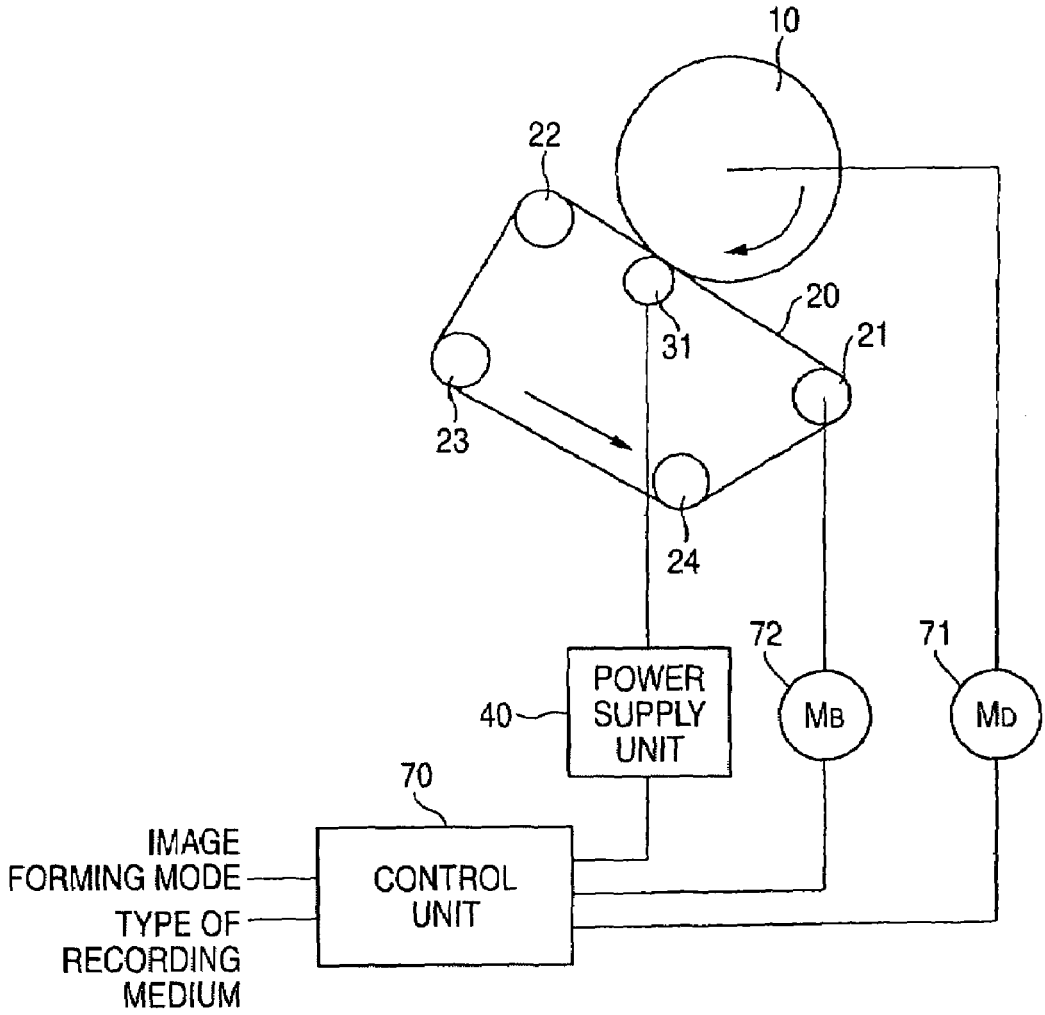
FIG. 5 shows a control system of the image forming apparatus according to the first embodiment of the invention.

According to this embodiment of the invention, as shown in FIG. 5, a control unit 70 sends out a predetermined control signal to the driving motor 71 ($M_D$ in FIG. 5) of the photosensitive drum 10, the driving motor 72 (MB therein) of the intermediate transfer belt 20, the power supply unit 40 of the transfer roll 31 and so forth depending on an image forming mode (a monochromatic mode, a color mode and so on) or the type of recording medium 50 (plain paper and OHP sheet) so as to control the image-forming and transfer conditions (see FIG. 6).

The operation of the imaging forming apparatus according to this embodiment will now be described.

<Monochromatic Mode>

Figures 6A, 6B, 6C:
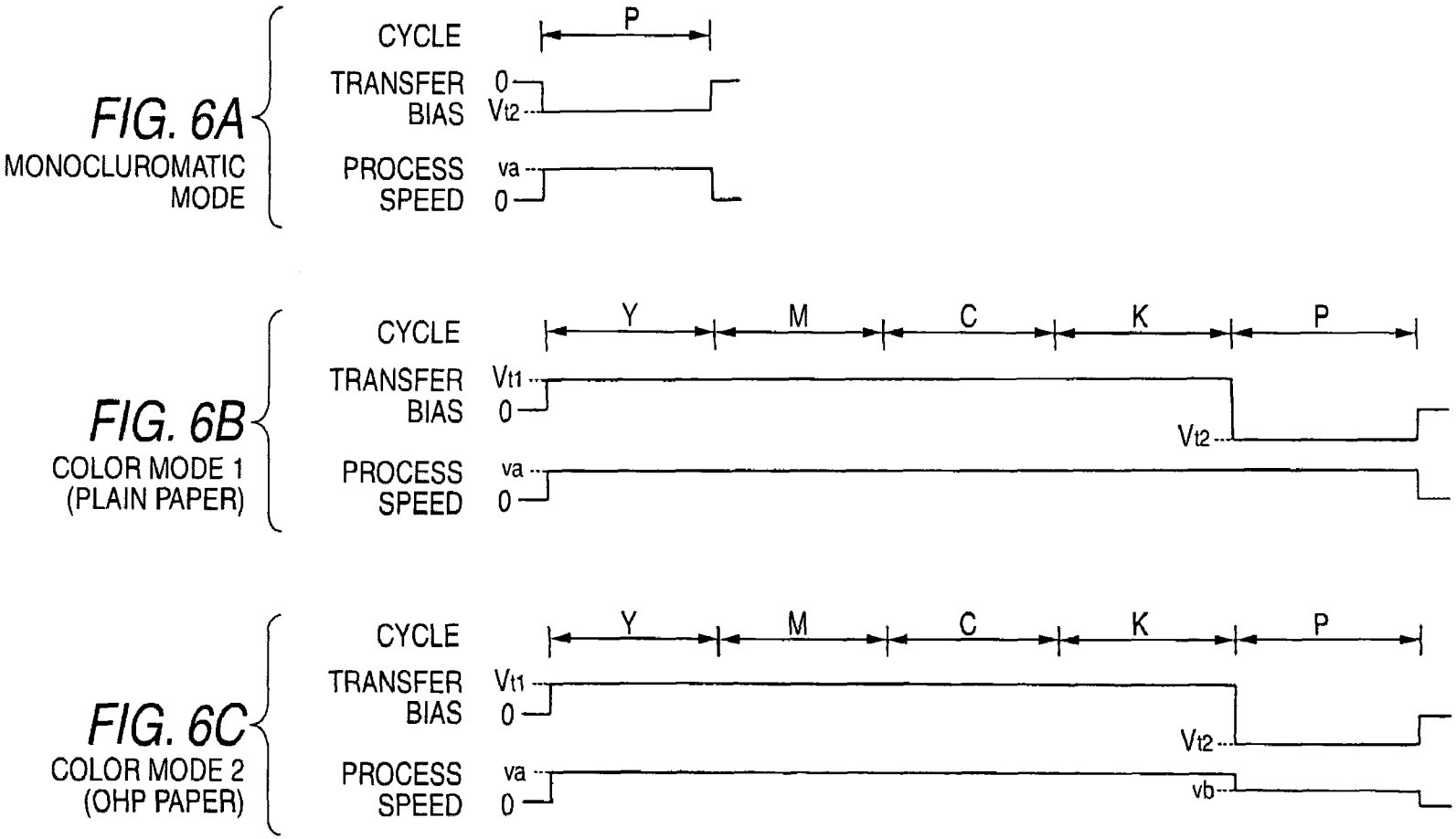
FIG. 6A shows an image forming process in a monochromatic mode.
FIG. 6B shows an image forming process in a color mode 1 (plain paper)
FIG. 6C shows an image forming process in a color mode 2 (OHP sheets)

When the control unit 70 selects a monochromatic mode, control unit 70 carries out a P cycle as shown in FIG. 6A to form a monochromatic toner image (e.g., black-and-white image) on the photosensitive drum 10 and conveys the recording medium 50 (e.g., plain paper) to the transfer region so as to transfer the chromatic toner image on the recording medium 50.

In the P cycle, a predetermined process speed va is employed and Vt2 equivalent to the secondary transfer bias is selected as a transfer bias at this time.

Thus, in the monochromatic mode, the monochromatic toner image formed on the photosensitive drum 10 is directly transferred to plain paper as the recording medium 50 without being subjected to the primary transfer to the intermediate transfer belt 20 and fixed by the fixing device 60.

Further, in case that the surface of the recording medium 50 subjected to printing is controlled (e.g., in the case of faceup where the printing side of the recording medium 50 is discharged faceup or in the case of facedown where the printing side thereof is discharged facedown), it is needless to say acceptable that the monochromatic image is primarily transferred to the intermediate transfer belt 20 once whereby to collectively transfer the monochromatic image to the recording medium 50.

<Color Mode 1 (Plain Paper)>

When the control unit 70 selects a color mode 1 (e.g., mode of selecting plain paper as the recording medium 50 in a full color mode), the control unit 70 carries out as shown in FIG. 6B, Y to K cycles (the primary transfer cycle of each color component) as well as the P cycle to sequentially form toner images with the respective color components (yellow (Y), magenta (M), cyan (C) and black (B)) on the photosensitive drum 10, makes the primary transfer of the toner images on the intermediate transfer belt 20 and then conveys the recording medium 50 (e.g., plain paper) to the transfer region so as to transfer the toner images with the respective color components on the intermediate transfer belt 20 to the recording medium 50.

The predetermined process speed va is employed in each of the Y to P cycles at this time and in the Y to P cycles, Vt1 equivalent to the primary transfer bias is selected as a transfer bias, whereas in the P cycle, Vt2 equivalent to the secondary transfer bias is selected as a transfer bias. Thus, the toner images with the respective color components formed on the photosensitive drum 10 is sequentially subjected to the primary transfer to the intermediate transfer belt 20, subjected to the secondary transfer to plain paper as the recording medium 50 and then fixed by the fixing device 60.

<Color Mode 2 (OHP Sheet)>

When the control unit 70 selects a color mode 2 (e.g., mode of selecting the OHP sheet (or thick paper) as the recording medium 50 in the full color mode), the control unit 70 carries out as shown in FIG. 6B and FIG. 6C the Y to K cycles (the primary transfer cycle of each color component) as well as the P cycle as in the color mode 1.

Unlike the color mode 1, however, the predetermined process speed va is employed in any one of the Y to K cycles and Vt1 equivalent to the primary transfer bias is selected as a transfer bias, whereas in the P cycle, a process speed vb (vb<va) is employed and Vt2 equivalent to the secondary transfer bias is selected as a transfer bias.

Thus, in the color mode 2, the toner images with the respective color components formed on the photosensitive drum 10 are sequentially subjected to the primary transfer to the intermediate transfer belt 20 and to the secondary transfer to the OHP sheet as the recording medium 50 at the low process speed and then fixed by the fixing device 60 at the low process speed. Therefore, the transfer and fixing of excellent image quality to the OHP sheet are materialized.

Next, this embodiment is compared with a comparative example.

Figure 7:
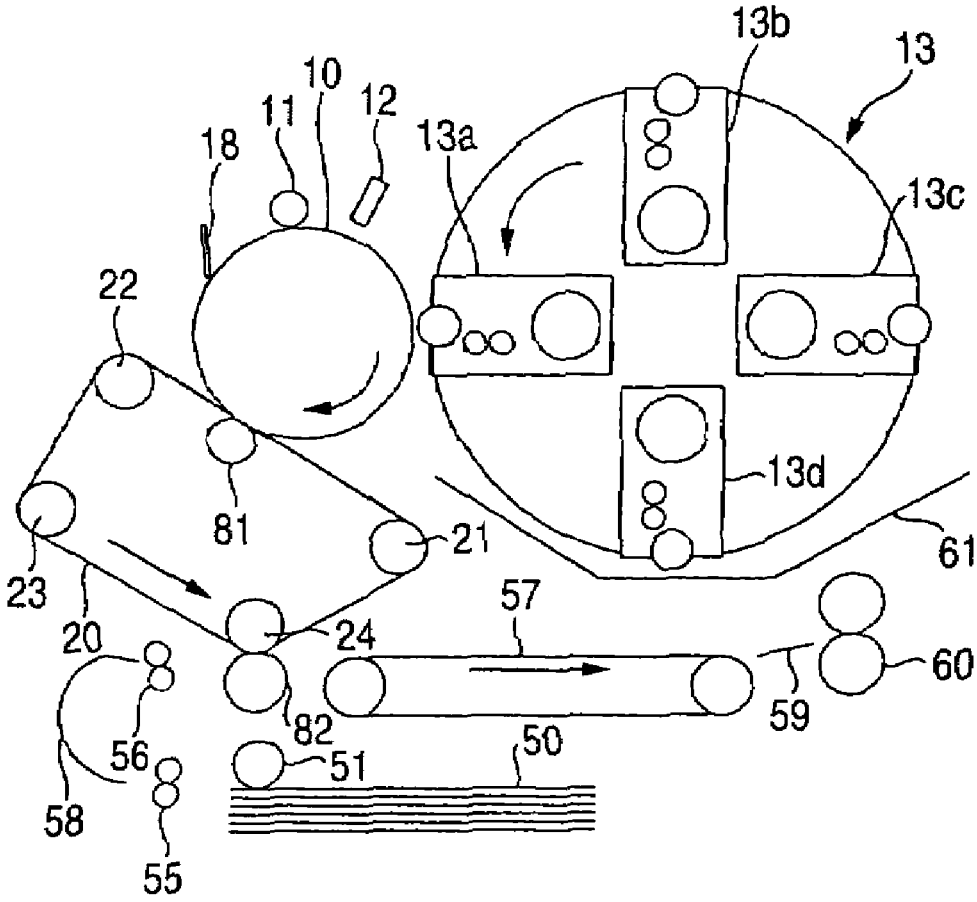
FIG. 7 shows an image forming apparatus as a comparative example 1.

As shown in FIG. 7, the operation of the comparative example includes disposing the intermediate transfer belt 20 opposite to the photosensitive drum 10, disposing a primary transfer roll 81 in the opposite portion to the photosensitive drum 10 and to the intermediate transfer belt 20, disposing a secondary transfer roll 82 in the opposite portion to one of the tension rolls 21-24 (e.g., 24) of the intermediate transfer belt 20, feeding off paper as the recording medium 50 with the feed roll 51, conveying the paper to a secondary transfer region via conveyance rolls 55 and resist rolls 56 and then conveying the paper to the fixing device 60 via a conveyance belt 57.

In FIG. 7, reference numerals 58 and 59 denote guide plates for guiding the recording medium 50, and 61, a shield plate for shutting off the heat of the fixing device 60. Hereinafter, like component elements are given like reference numerals according to this embodiment of the invention and the detailed description thereof will be omitted.

In FIG. 3 and FIG. 7, a comparison between the image-forming time according to this embodiment of the invention and the comparative example reveals that since the primary transfer cycle with respect to the intermediate transfer belt 20 can be dispensed with in the monochromatic mode, the image-forming cycle according to this embodiment thereof is made shorter than that in the comparative example; however, as the image-forming time becomes greater to the extent of the P cycle than that in the comparative example in the color mode, a certain amount of image-forming cycle time is sacrificed according to the embodiment.

As the transfer roll 31 implements both the primary transfer and the secondary transfer according to the embodiment, however, not only does the secondary transfer roll 82 in the comparative example become unnecessary, but the intermediate transfer belt 20 between the tension rolls 21 and 22 is usable as part of the conveyance path of the recording medium 50, so that the conveyance space of the recording medium 50 is reducible to that extent.

In the embodiment, since the recording medium 50 passes through the surface of the intermediate transfer belt 20, dust generated from papers tends to adhere on the intermediate transfer belt 20. However, the dust is effectively removed with the toner residue on the intermediate transfer belt 20 by a belt cleaning device which is not shown in the figure.

Second Embodiment

Figure 8:
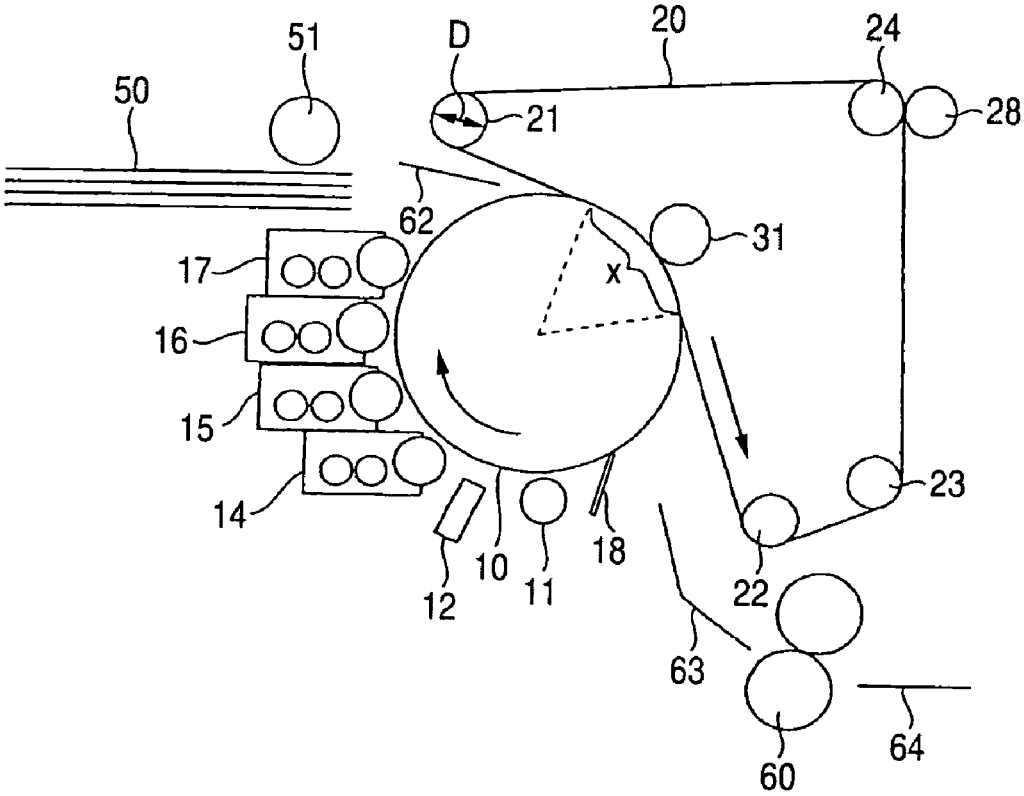
FIG. 8 shows the overall configuration of an image forming apparatus according to a second embodiment of the invention.

FIG. 8 shows the overall configuration of an image forming apparatus according to a second embodiment.

In FIG. 8, the image forming apparatus has the photosensitive drum 10 and the intermediate transfer belt 20 that is kept in con-tact with the photosensitive drum 10 along the periphery of the photosensitive drum 10 in a predetermined area and used for transferring toner images from the photosensitive drum 10.

According to the embodiment, the following are provided in predetermined locations around the photosensitive drum 10: the charging device 11 for electrically charging the photosensitive drum 10, the exposure device 12 for writing electrostatic latent images with various color components (black, yellow, magenta and cyan in this example) to the photosensitive drum 10 thus electrically charged, four developing units 14-17 for converting the latent images with the respective color components formed on the photosensitive drum 10 into visible images with toner having corresponding color components, the intermediate transfer belt 20, and the cleaner 18 for cleaning out the residual toner on the photosensitive drum 10.

According to the embodiment, though any intermediate transfer belt 20 made of proper material such as resin or rubber may be selected, the contact surface pressure with the photosensitive drum 10 needs lowering in order to effectively suppress image quality defects such as hollow characters and moreover it is preferred to use an elastic belt material with elastic rubber as a basis in consideration of the point of view of walklessness and tensionerlessness.

In this case, material normally having a Young's modulus of not greater than 100 Mpa is employed as elastic belt material and a volume resistivity (of e.g., $10^6$-$10^{12}$ Ω·cm) is necessary for the elastic basal body of the intermediate transfer belt 20 to maintain transfer performance. When surface cleanability is taken into consideration, moreover, it is preferred to provide a release layer on the surface of the elastic basal body.

What has a Young's modulus of 15-80 Mpa as a desirable physical property value for the elastic basal body is preferred so as to retain good transfer performance.

As good raw materials, urethane rubber (soft type: 16.9 Mpa), urethane rubber (hard type: 78.6 Mpa) and chloroprene rubber (16.2 Mpa) are enumerated.

Conversely, as undesirable raw materials, PET (1.47 Gpa) and PC (1.96 Gpa) are enumerated.

According to this embodiment, further, the intermediate transfer belt 20 is laid in a tensioned condition over the plurality (e.g., four) of tension rolls 21-24 and arranged in only a predetermined contact area x such that the intermediate transfer belt 20 is kept in tight contact with the periphery of the photosensitive drum 10 positioned between the developing units 14-17 and the cleaner 18.

In the embodiment, four of the tension rolls 21-24 are driven rolls and the tension roll 21 positioned on the upstream side of the transfer position out of the tension rolls 21-24 is arranged such that the winding angle of the intermediate transfer belt 20 is set greatest.

Especially, in the embodiment, the contact area x between the photosensitive drum 10 and the intermediate transfer belt 20 is arranged to ensure that the area x at least covers the perimeter (IID:D is the diameter of the tension roll 21) of the tension roll 21 positioned on the upstream side of the transfer position.

In the case that the diameter D of the tension roll 21 is smaller than those of the other tension rolls 22-24, the contact area between the photosensitive drum 10 and the intermediate transfer belt 20 is set smallest, which is not necessarily restrictive however.

Figure 9:
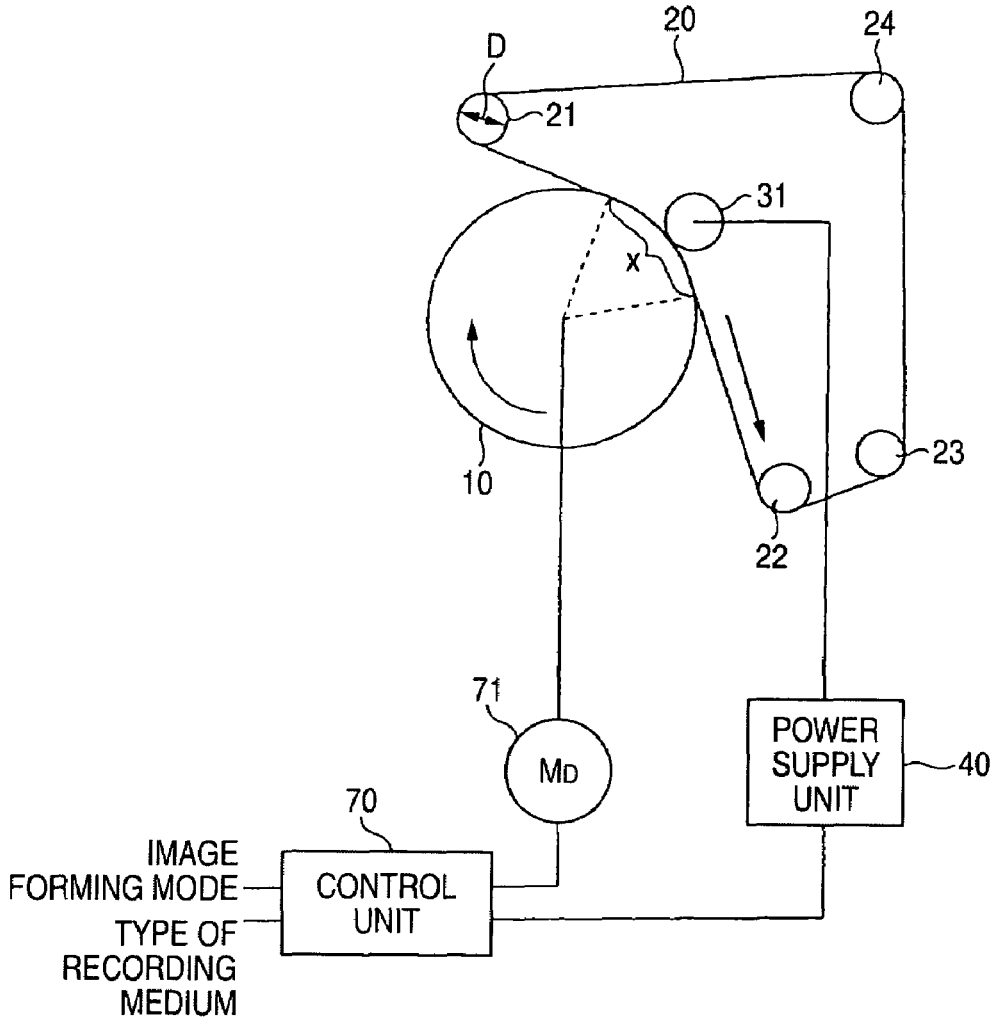
FIG. 9 shows a control system of the image forming apparatus according to the second embodiment of the invention.

In the embodiment, the photosensitive drum 10 is as shown in FIG. 9 driven to rotate by the driving motor 71 (sign $M_D$) and the intermediate transfer belt 20 is driven to rotate via the contact area x with the photosensitive drum 10 as a drive source.

Further, the transfer roll 31 is so arranged as to contact the intermediate transfer belt 20 from its back side in part of the contact area x where the intermediate transfer belt 20 is in tight contact with the photosensitive drum 10. The power supply unit 40 is connected to the transfer roll 31, so that the primary transfer bias or the secondary transfer bias is selectively applied.

As shown in FIG. 9, the control unit 70 sends out a predetermined control signal to the driving motor 71 ($M_D$ in FIG. 9) of the photosensitive drum 10, to the power supply unit 40 of the transfer roll 31 and so forth depending on the image forming mode and the type of recording medium 50 to control the image-forming and transfer conditions (see FIG. 6).

As the recording medium 50 such as paper is stored in a feed tray (not shown), the recording medium 50 is led to the opposite portion (transfer region) to the photosensitive drum 10 and to the intermediate transfer belt 20 after being supplied by the feed roll 51 and then conveyed to the fixing device 60. Reference numeral 28 in FIG. 8 denotes a belt cleaner using a cleaning roll; 62, a guide plate for guiding the recording medium 50 to the transfer position; 63, a guide plate for guiding the recording medium 50 on the intermediate transfer belt 20 to the fixing device 60; and 64, a guide plate for guiding the recording medium passed through the fixing device 60 to an output tray (not shown).

The operation of the imaging forming apparatus of the embodiment will now be described.

In the monochromatic mode and the color modes 1 and 2, image-forming cycles substantially similar to those in the first embodiment of the invention are carried out.

In contrast with a comparative example 2 (see FIG. 11) wherein a secondary transfer device (the secondary transfer roll 82) is provided separately from a primary transfer device (the primary transfer roll 81), it is unnecessary to leave space for providing the secondary transfer device in a predetermined location, which results in reducing the conveyance path space for the recording medium 50, whereby it is understandable that a reduction in the size and cost of and a saving in space for the apparatus is realizable.

Figure 11:
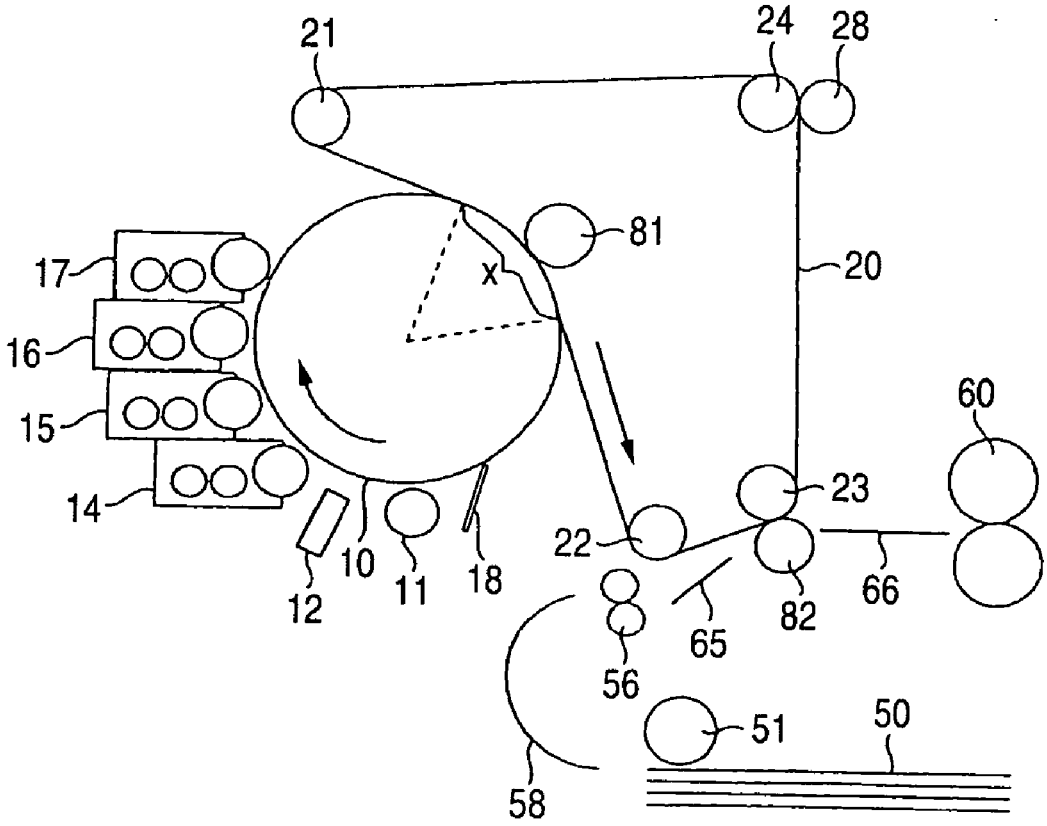
FIG. 11 shows an image forming apparatus as a comparative example 2.

In FIG. 11, reference numeral 56 denotes a resist roll; and 58, 65 and 65, guide plates for guiding the recording medium 50 to a predetermined region.

As the intermediate transfer belt 20 undergoes an fluctuation in speed the shaking and eccentric error of the tension roll 21 during the image-forming process above according to this embodiment of the invention, the toner image on the photosensitive drum 10 is separated from the intermediate transfer belt 20 on receiving mechanical shearing force in the contact area x and substantially no peripheral speed difference between the photosensitive drum 10 and the intermediate transfer belt 20 is generated in the contact area x.

Therefore, an excellent color image without banding and out-of-color-registration becomes readily available.

In the image-forming process, further, though a transfer electric field deriving from the transfer roll 31 acts on the contact area x between the photosensitive drum 10 and the intermediate transfer belt 20, an air gap at both ends of the contact area x becomes never affected by the transfer electric field by making the transfer action area of the transfer roll 31 stay in the contact area x.

Therefore, toner images on the photosensitive drum 10 are surely transferred toward the intermediate transfer belt 20 within the contact area x without causing toner to abnormally fly in the air gap portion to ensure that the toner images on the intermediate transfer belt 20 are transferred to the recording medium 50.

Although a drive mechanism for the intermediate transfer belt 20 itself is omitted, the intermediate transfer belt 20 is made rotatable with stability in response to the rotation of the photosensitive drum 10 and moreover the original peripheral speed difference can be eliminated in contrast with a case where each has its own drive source.

That is, there occurs a peripheral speed difference due to the rotational error of the drive source and the error of a drive transmission system when the photosensitive drum 10 and the intermediate transfer belt 20 are allowed to have their own drive sources, whereupon a slip is made between the photosensitive drum 10 and the intermediate transfer belt 20. Consequently, only the photosensitive drum 10 has a drive source so that the intermediate transfer belt 20 is driven to rotate as in this embodiment of the invention, wherein both of them are caused to rotate at the same speed whereby to suppress a slip between them and to maintain the transfer performance in good condition.

Especially, in the embodiment, as the intermediate transfer belt 20 is made an elastic belt with an elastic basal body having a predetermined Young's modulus according to this embodiment of the invention in particular, the driven rotation can be stabilized.

Figure 10:
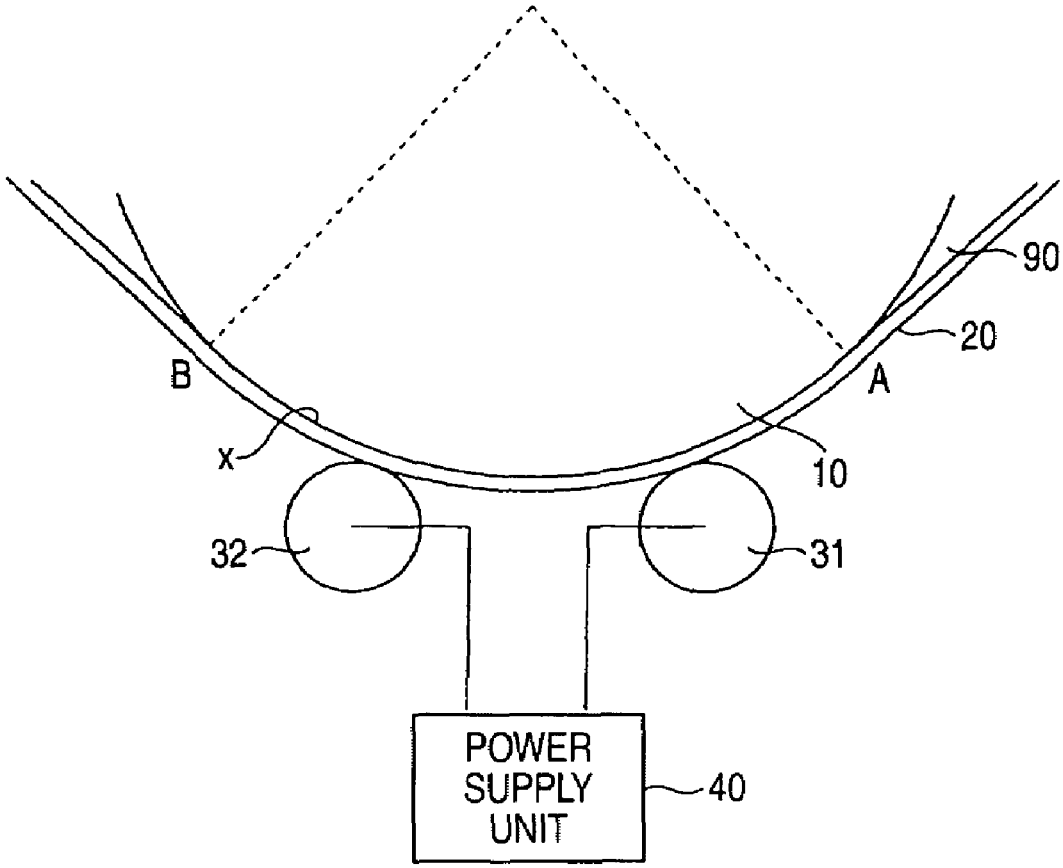
FIG. 10 shows a modified transfer device for use in the second embodiment of the invention.

As a predetermined range of contact area x is secured between the photosensitive drum 10 and the intermediate transfer belt 20 according to this embodiment of the invention, a plurality of transfer rolls 31 and 32 are provided in predetermined locations in regions excluding both ends A and B out of the contact area x as shown in FIG. 10, for example, so that the primary transfer bias or the secondary transfer bias is applied with the power supply unit 40.

In this case, both of the transfer rolls 31 and 32 may be used for the primary transfer and the secondary transfer, or the one transfer roll 31 may be used for the primary transfer and the other transfer roll 32 may be used for the secondary transfer. These embodiment are selected according to a case.

Further, the reason for the exclusion of both ends A and B of the contact area x as the positions where the transfer rolls 31 and 32 are located is that air gaps 90 existing at both ends of the contact area x are affected by the transfer action area of the transfer rolls 31 and 32, so that toner is prevented from being caused to scatter by abnormal electric discharge.

Third Embodiment

Figure 12:
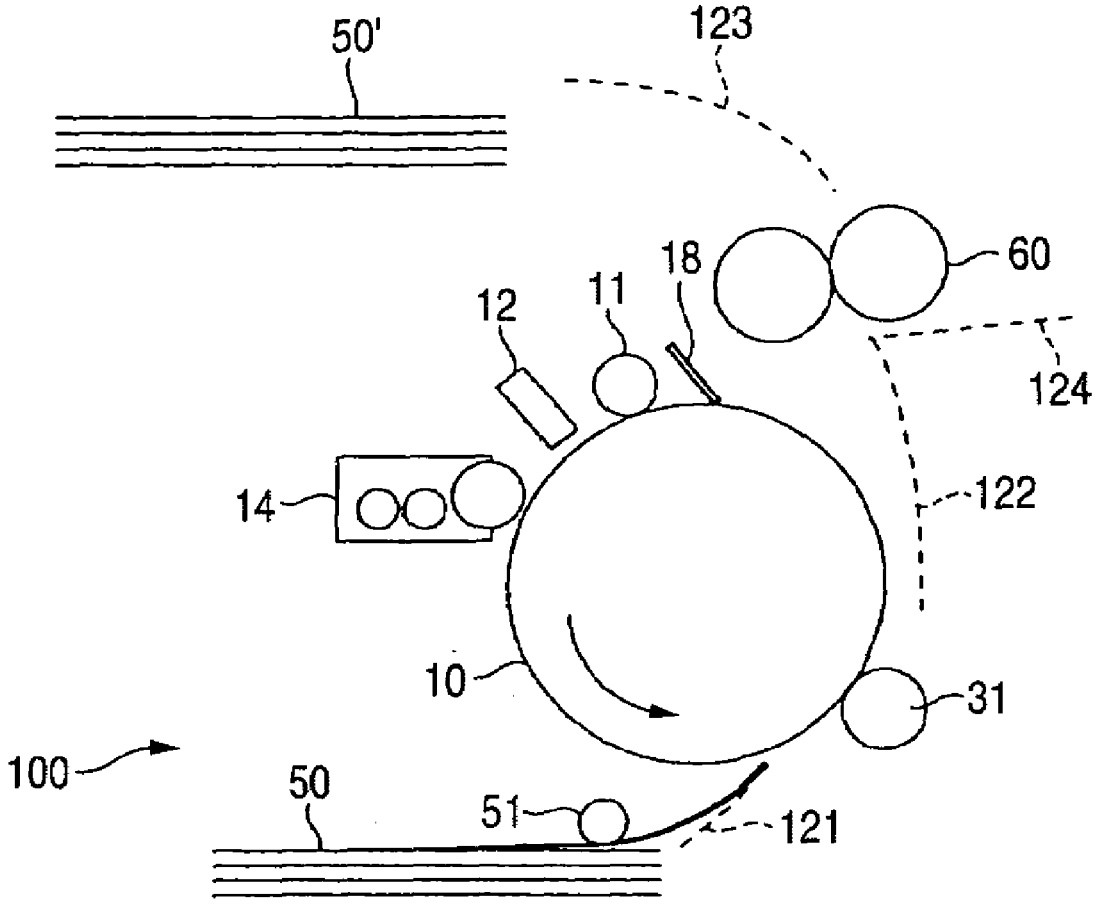
FIG. 12 shows the basic unit configuration of an image forming apparatus according to a third embodiment of the invention.
Figure 13:
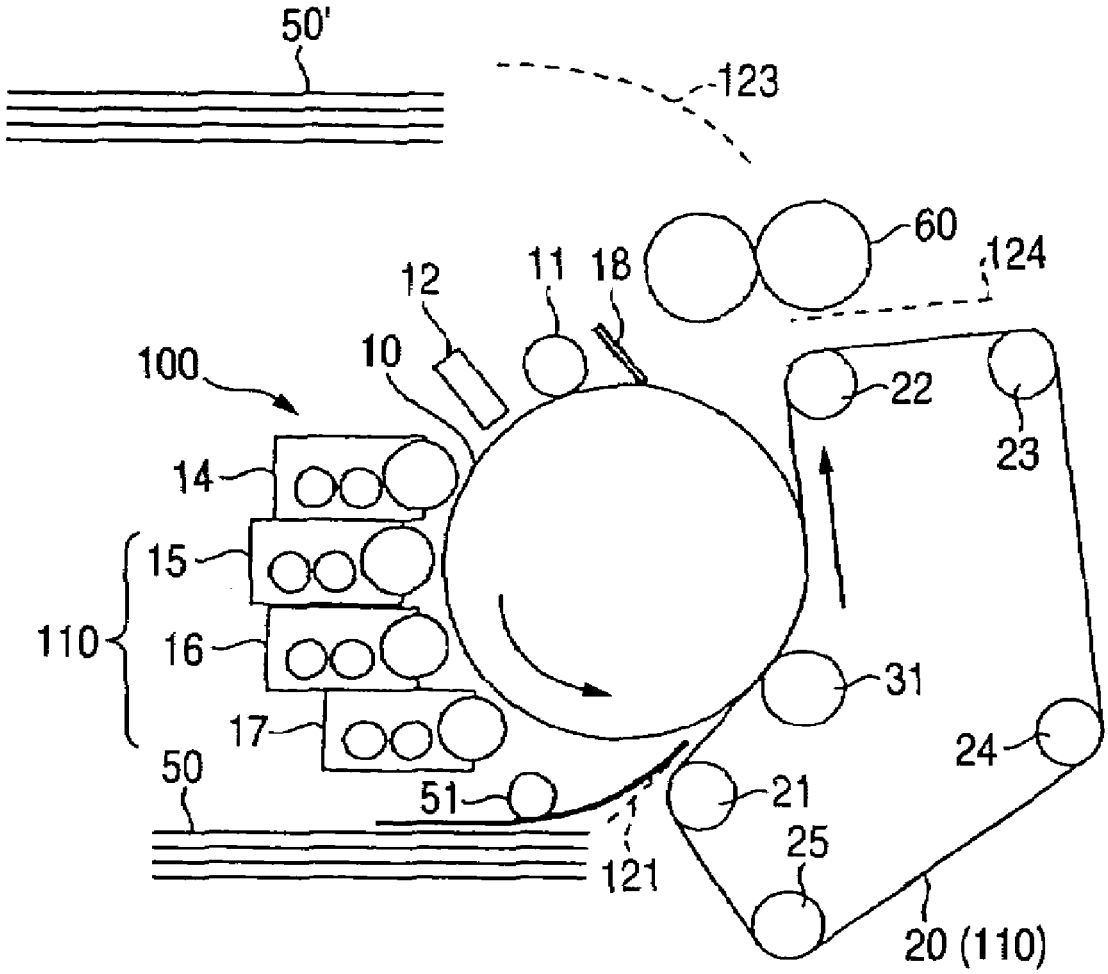
FIG. 13 shows a configuration of "basic unit+an optional unit" in the image forming apparatus according to the third embodiment of the invention.

FIG. 12 and FIG. 13 show image forming apparatus according to a third embodiment of the invention.

The image forming apparatus according to the embodiment is adapted to be graded up from a monochromatic image forming apparatus to a color-image forming apparatus in compliance with user's demands.

FIG. 12 shows the monochromatic image forming apparatus of the embodiment, which is provided with a basic unit 100 for use in forming monochromatic images.

The basic unit 100 has the photosensitive drum 10 and around the photosensitive drum 10, the following are provided in predetermined locations: the charging device 11, the exposure device 12, the monochrome developing unit 14 (a black color developing unit in this example), the transfer roll 31 and the cleaner 18, wherein the recording medium 50 is conveyed by the transfer roll 31 to the transfer region; and the monochromatic image formed on the photosensitive drum 10 is transferred to the recording medium 50 before being led to the fixing device 60.

In FIG. 12, reference numerals 121-123 denote guide plates for guiding the recording medium 50, 124 denotes a part of a support frame, and 50' denotes the recording medium discharged into the output tray (not shown).

FIG. 13 shows a color-image forming apparatus which is graded up from the monochromatic image forming apparatus, with optional units 110 additionally provided.

As the optional units 110 according to this embodiment of the invention, the following are enumerated: for example, color-image developing units 15-17 (yellow (Y), magenta (M) and cyan (C)) and the intermediate transfer belt 20 held between the photosensitive drum 10 and the transfer roll 31 (stretched by tension rolls 21-25 in this example).

In this case, though a proper layout may be selected for the photosensitive drum 10 and the intermediate transfer belt 20, the intermediate transfer belt 20 is so disposed as to be in contact with the photosensitive drum 10 along its configuration in a predetermined contact area, for example.

A power supply unit (not shown) is connected to the transfer roll 31, so that the primary transfer bias or the secondary transfer bias is selectively applied.

A guide plate 122 interfering with the optional intermediate transfer belt 20 is removed when the intermediate transfer belt 20 is provided in a predetermined location.

The color-image forming apparatus of this kind is capable of forming a chromatic toner image on the photosensitive drum 10 and transferring the toner image directly to the recording medium 50 in the chromatic mode, for example. When the printing side of the recording medium 50 is controlled, however, the toner image may be primarily transferred to the intermediate transfer belt 20 once before being subjected to the secondary transfer.

In the color mode, on the other hand, toner images with the respective color components may sequentially be formed on the photosensitive drum 10 and sequentially transferred to the intermediate transfer belt 20, Then the toner images subjected to multiplex primary transfer to the intermediate transfer belt 20 may collectively be subjected to the secondary transfer.

In the embodiment, the optional units 110 may be sold in the form of a kit in view of increasing the user's freedom so that the user is allowed to do the work of adding the optional units 110 directly. However, the work of adding the optional units 110 may be done on the part of the manufacturer in view of maintaining high image quality.

In the embodiment, moreover, the introduction of the optional units above is preferable in view of cost reduction by arranging parts of the monochromatic image forming apparatus and the color image forming apparatus for common use, to say nothing of aiming the grade-up of the image forming apparatus.

In the embodiment, though the transfer roll 31 is used as a common part by both the monochromatic image forming apparatus and the color image forming apparatus, for example, the transfer roll 31 of the monochromatic image forming apparatus may be replaced with an intermediate transfer belt unit (in the mode of incorporating a transfer roll) in the mode of incorporating the transfer roll in the intermediate transfer belt, for example.

Figure 14:
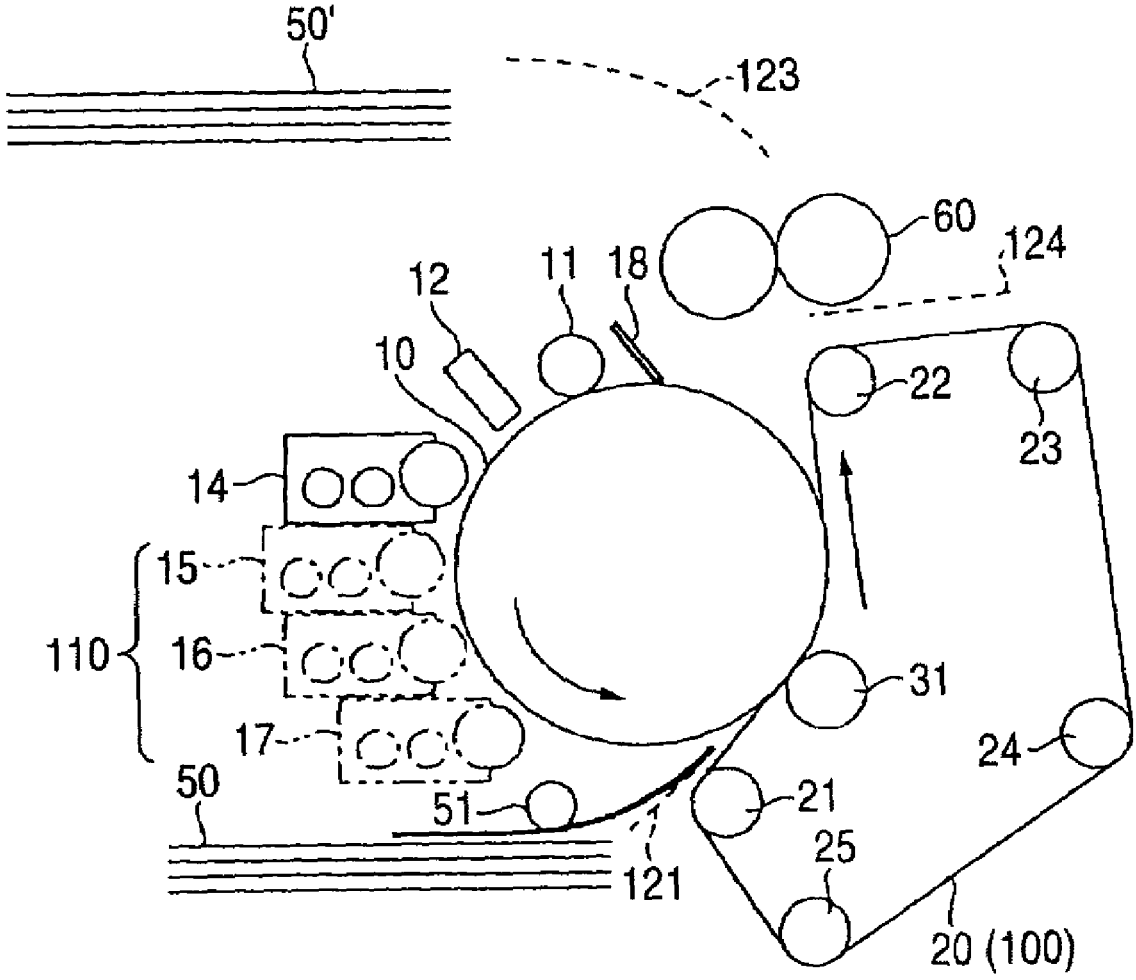
FIG. 14 shows a modified image forming apparatus according to the third embodiment of the invention.

As shown in FIG. 14, for example, with the basic unit 100 incorporating the intermediate transfer belt 20 beforehand, only the color-image developing units 15-17, for example, may be additionally provided as optional units 110.

EXAMPLE 1

The image forming apparatus according to the first embodiment of the invention is embodied in this example 1.

The photosensitive drum 10 which is made of an organic material and has a diameter of 84 mm is used in this example.

The intermediate transfer belt 20 is a belt having polyimide resin as its main ingredient, having a Young's modulus of about $3\times10^3$ Mpa and a volume resistivity of as high as $10^8$-$10^{12}$ Ω·cm.

The toner for use in this example was negative toner, whereupon the primary transfer condition was to carry out the transfer by applying to the transfer roll 31 the primary transfer bias having positive polarity so that a current of 20 μA was made to flow from the transfer roll 31 toward the intermediate transfer belt 20 with constant-current control.

The secondary transfer condition was to carry out the transfer by applying to the transfer roll 31 the secondary transfer bias having negative polarity (−2.5 kV in this example) so that the current was made to flow from the transfer roll 31 toward the intermediate transfer belt 20 with the constant-current control.

In this example, chromatic images and color images of good quality were obtained in the chromatic mode and the color modes 1 and 2.

EXAMPLE 2

The image forming apparatus according to the second embodiment of the invention is embodied in this example.

The photosensitive drum 10 which is made of an organic material and has a diameter of 84 mm is used in this example.

The intermediate transfer belt 20 is a belt having chloroprene rubber as its main ingredient, having a Young's modulus of about 30 Mpa and a volume resistivity of as high as $10^9$ Ω·cm. A urethane coating layer for improving the release properties of the toner is formed on the surface of the belt.

Further, the intermediate transfer belt 20 was in contact with the photosensitive drum 10 at 55° (40 mm in terms of distance). As the diameter of the tension roll 21 of the intermediate transfer belt 20 is 12 mm (about 37 mm perimeter), what is not less than the value was set.

As the toner for use in this example was negative toner, the primary transfer condition was to carry out the transfer by applying to the transfer roll 31 the primary transfer bias having positive polarity so that a current of 10 μA was made to flow from the transfer roll 31 toward the intermediate transfer belt 20 with the constant-current control.

The secondary transfer condition was to carry out the transfer by applying to the transfer roll 31 the secondary transfer bias having negative polarity (−1.5 kV in this example) so that the current was made to flow from the transfer roll 31 toward the intermediate transfer belt 20 with the constant-current control.

In this example, chromatic images and color images of good quality were obtained in the chromatic mode and the color modes 1 and 2.

Fourth Embodiment

Figure 15A:
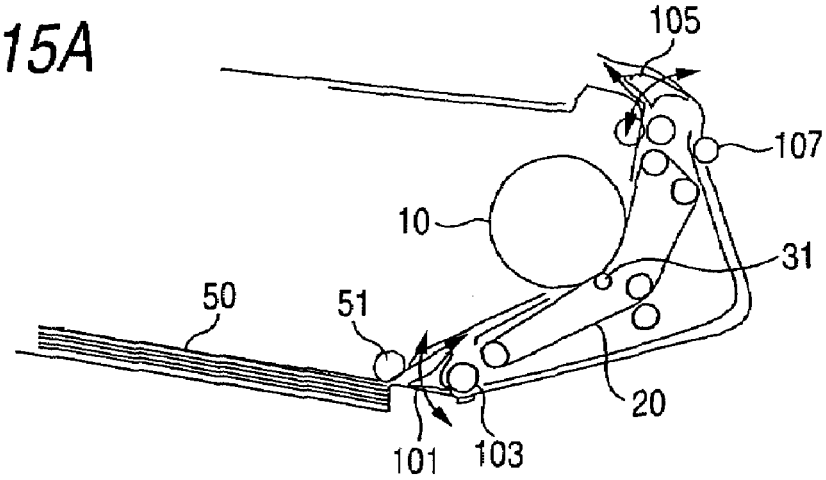
FIGS. 15A to 15C show the overall configurations of an image forming apparatus according to a fourth embodiment of the invention.
Figure 15B:
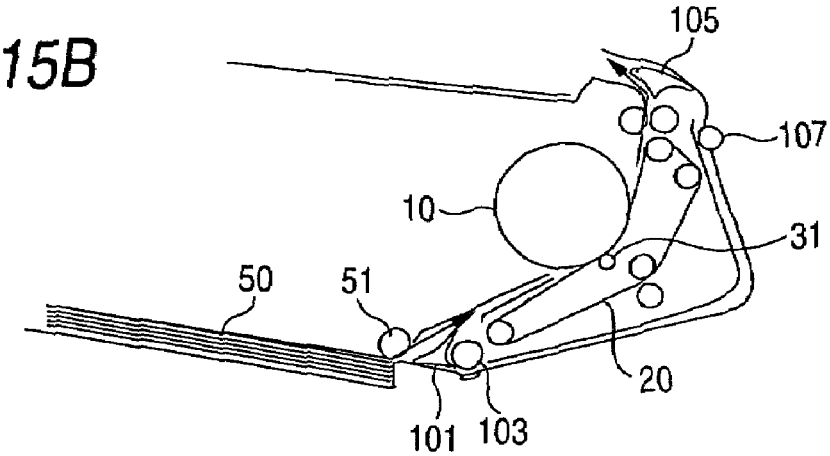
Figure 15C:
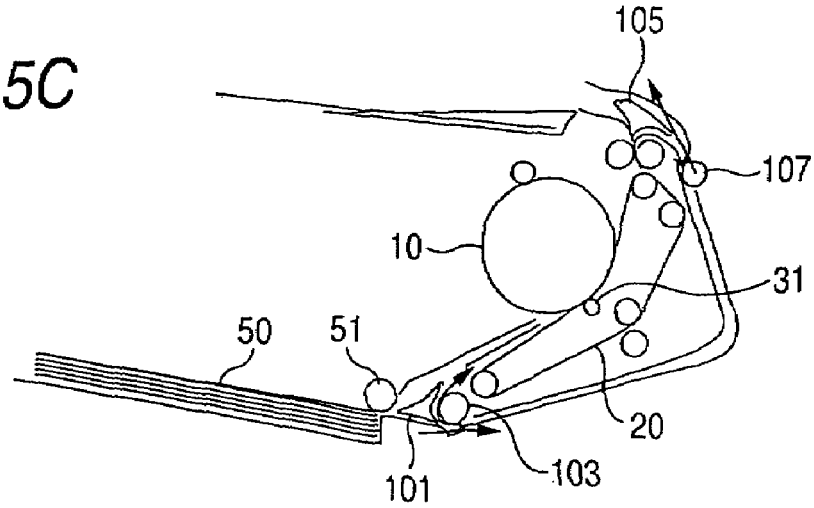

FIG. 15A-FIG. 15C show the overall configurations of image forming apparatus according to a fourth embodiment. As shown in FIG. 15A, the image forming apparatus of the fourth embodiment is additionally provided with a feeder guide 101, a feeder reverse roll 103, a feeder output guide 105 and a feeder output reverse roll 107 as compared with the image forming apparatus according to the first embodiment thereof.

The feeder guide 101 is a substantially triangular guide for switching between the two directions of movement of the recording medium 50 drawn by means of the feed roll 51 in accordance with the image forming mode. In the monochromatic mode, the feeder guide 101 guides the recording medium 50 in the direction of moving to the opposite portion (transfer region) to the photosensitive drum 10 and to the intermediate transfer belt 20 as shown in FIG. 15B. In the color mode, on the other hand, the feeder guide 101 sandwiches the intermediate transfer belt 20 and guides the recording medium 50 in the direction of a space on the opposite side to the opposite portion above as shown in FIG. 15C.

The feeder reverse roll 103 guides the recording medium 50 guided to the space in the opposite direction and while making the feeder guide 101 sandwich the recording medium 50, guides the recording medium 50 to the opposite portion in the color mode. Consequently, the recording medium 50 turned upside down is guided to the opposite portion in the color mode contrary to the monochromatic mode.

The feeder output guide 105 is a substantially triangular guide for switching between the two directions of movement of the recording medium 50 with the toner image fixed thereon in accordance with the image forming mode. In the monochromatic mode, the feeder output guide 105 guides the recording medium 50 outside along the direction of movement of the recording medium from the fixing device 60 as shown in FIG. 15B. In the color mode, on the other hand, the feeder output guide 105 guides the control unit 70 in the substantially opposite direction to the direction of movement of the recording medium from the fixing device 60 as shown in FIG. 15C.

The feeder output reverse roll 107 again guides the recording medium 50 guided to the substantially opposite direction to the direction of movement from the fixing device 60. The recording medium 50 guided by the feeder output reverse roll 107 is guided outside along a guide face different from the guide face that the recording medium 50 is guided in the monochromatic mode of the feeder output guide 105. Therefore, the printing side of the recording medium 50 to which the toner image is transferred with the recording medium 50 turned upside down is discharged in the same direction as that in the monochromatic mode.

Thus, the recording medium 50 can be discharged with the printing side oriented in the same direction even though the toner image transfer side is turned upside down in the image forming apparatus. Therefore, printing can be made on the desired side of the recording medium 50, irrespective of the image forming mode.

Fifth Embodiment

Figure 16A:
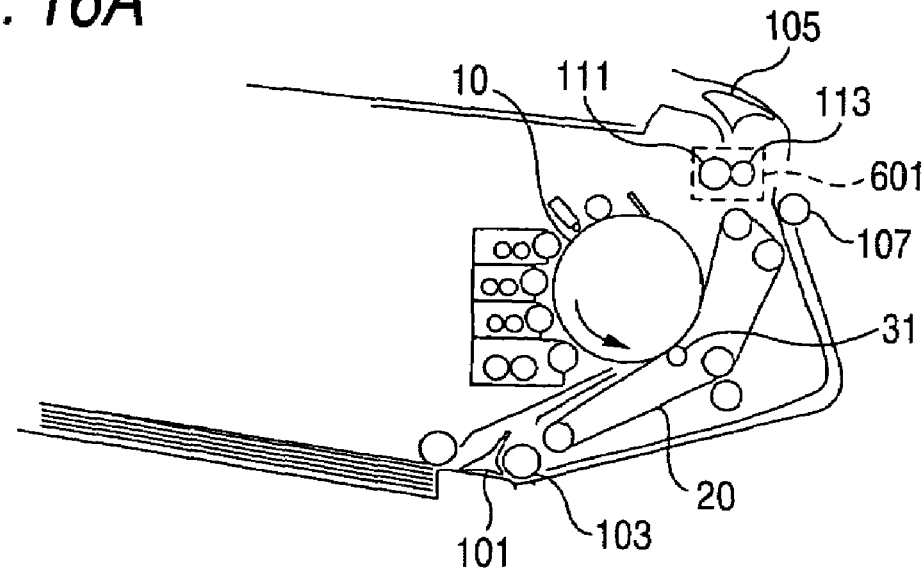
FIG. 16A and FIG. 16B show the overall configurations of an image forming apparatus according to a fifth embodiment of the invention.
Figure 16B:
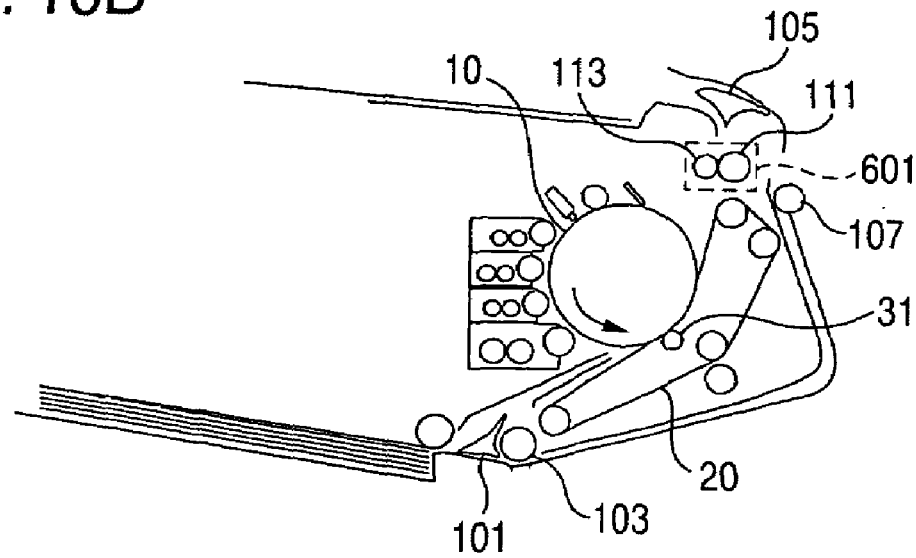

FIG. 16A and FIG. 16B show the overall configurations of image forming apparatus according to a fifth embodiment. The image forming apparatus of the fifth embodiment is provided with a fixing device 601 having a heat roll for heating the recording medium 50 and a pinch roll 113 for rotatably pinching the recording medium 50 with the heat roll 111. The image forming apparatus according to this embodiment of the invention is also provided with a reversing portion (not shown) for changing by 180 degrees the positions of the heat roll 111 and the pinch roll 113 with respect to the surface of the recording medium 50. The reversing portion reverses the fixing device 601 in accordance with the image forming mode.

In the monochromatic mode, the recording medium 50 is led to the fixing device 601 with the transfer side set opposite to the photosensitive drum 10 as shown in FIG. 16A. Therefore, the reversing portion positions the fixing device 601 so that the heat roll 111 opposes the photosensitive drum 10. In the color mode, on the other hand, the recording medium 50 is led to the fixing device 601 with the transfer side set opposite to the intermediate transfer belt 20 as shown in FIG. 16B. Therefore, the reversing portion positions the fixing device 601 so that the heat roll 111 opposes the intermediate transfer belt 20.

Thus, the transfer side of the recording medium 50 comes into contact with the heat roll 111 even, though the toner image transfer side is turned upside down in the image forming apparatus. Therefore, it is ensured that the toner image can be fixed to the recording medium 50, irrespective of the image forming mode.

Sixth Embodiment

Figure 17A:
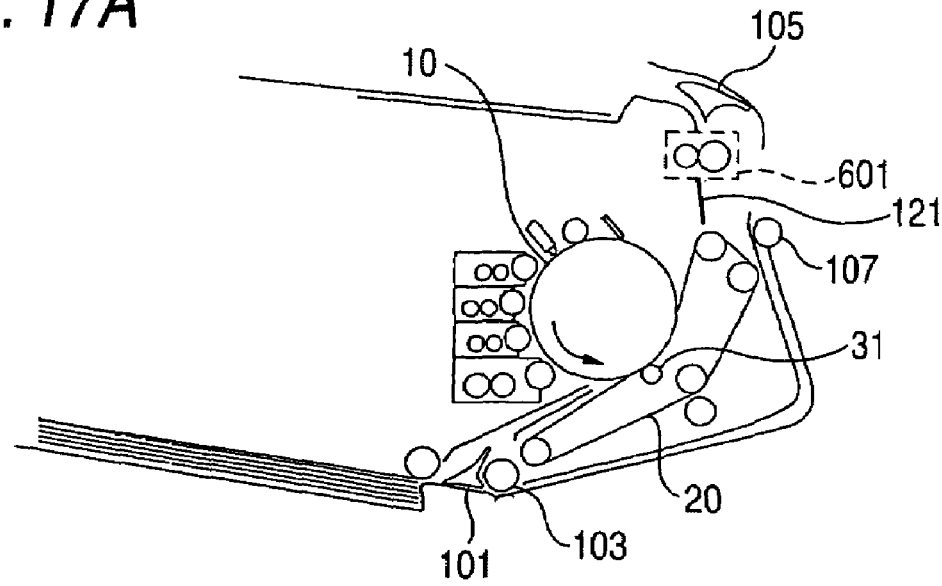
FIG. 17A and FIG. 17B show the overall configurations of an image forming apparatus according to a sixth embodiment of the invention.
Figure 17B:
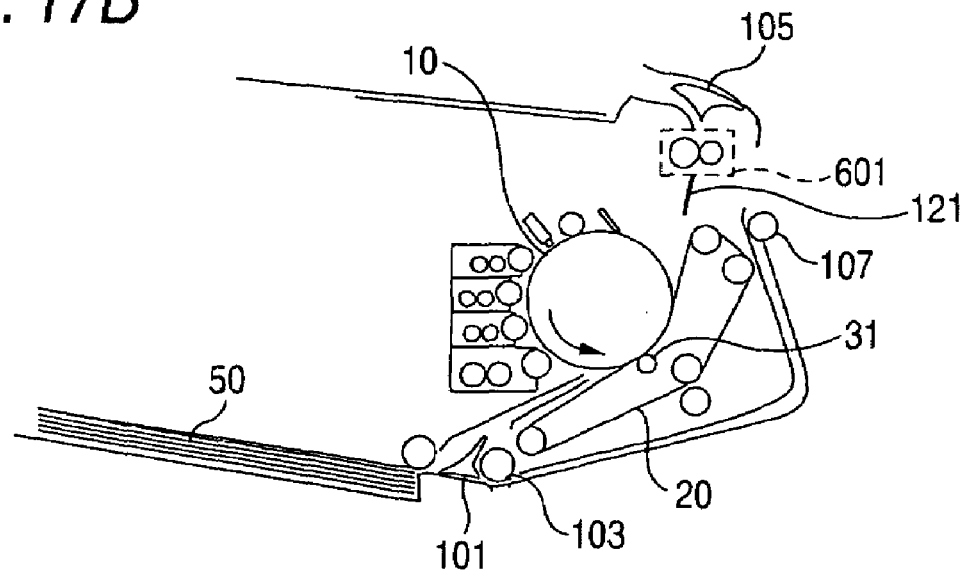

FIG. 17A and FIG. 17B show the overall configurations of image forming apparatus according to a sixth embodiment. As shown in FIG. 17A, the image forming apparatus of the sixth embodiment of the invention is further provided with a guide 121 and a guide direction switching portion (not shown).

The guide 121 guides the recording medium 50 in such a state as before the fixation of the transferred toner image to the fixing device 601 and is rotatable with respect to the recording medium 50. The guide direction switching portion switches directions of the recording medium 50 toward the guide 121 in accordance with the image forming mode. The guide 121 is directed toward the side to which the toner image of the recording medium 50 is not transferred.

In the monochromatic mode, since the side to which the toner image of the recording medium 50 is not transferred is the side of the intermediate transfer belt 20, the guide 121 is directed to the side of the intermediate transfer belt 20 as shown in FIG. 17A. In the color mode, on the other hand, since the side to which the toner image of recording medium 50 is not transferred is the side of the photosensitive drum 10, the guide 121 is directed to the side of the photosensitive drum 10.

Therefore, even though the transfer side of the toner image is turned upside down in the image forming apparatus, the toner image before being subjected to fixation is never disturbed by the guide 121. However, a fixing device in which two of the rollers may be heat rollers instead of the fixing device 601 according to this embodiment of the invention.

Seventh Embodiment

Figure 18A:
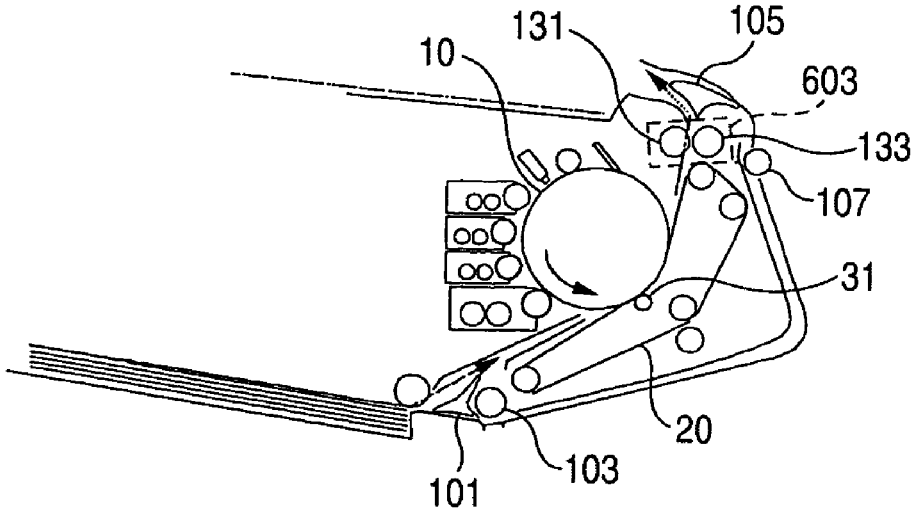
FIG. 18A and FIG. 18B show the overall configurations of an image forming apparatus according to a seventh embodiment of the invention.
Figure 18B:
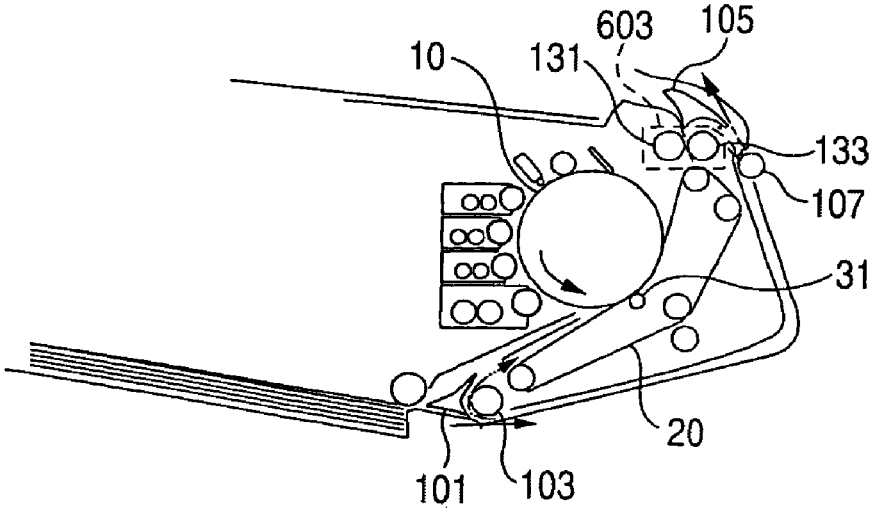

FIG. 18A and FIG. 18B show the overall configurations of image forming apparatus according to a seventh embodiment. A fixing device 603 that the image forming apparatus has of the seventh embodiment is equipped with a first heat roll 131 and a second heat roll 133 for heating the recording medium 50. The recording medium 50 is rotatably sandwiched between the first heat roll 131 and the second heat roll 133. The fixing device 603 fixes the image transferred to the recording medium 50 by means of heat from one of the heat rolls.

In the monochromatic mode, the recording medium 50 is led to the fixing device 603 with the transfer side set opposite to the photosensitive drum 10 as shown in FIG. 18A. Therefore, the fixing device 603 heats the recording medium 50 by using the first heat roll 131 disposed on the side of the photosensitive drum 10. At this time, the second heat roll 133 disposed on the side of the intermediate transfer belt 20 does not heat the recording medium 50 but simply rotatably holds the recording medium 50 with the first heat roll 131.

In the color mode, on the other hand, the recording medium 50 is led to the fixing device 603 with the transfer side set opposite to the intermediate transfer belt 20 as shown in FIG. 18B. Therefore, the fixing device 603 heats the recording medium 50 by using the second heat roll 133 disposed on the side of the intermediate transfer belt 20. At this time, the first heat roll 131 disposed on the side of the photosensitive drum 10 does not heat but simply rotatably holds the recording medium 50 with the second heat roll 133.

The transfer side of the recording medium 50 comes into contact with the heat roll on the transfer side of the recording medium 50 even though the toner image transfer side is turned upside down in the image forming apparatus. Therefore, it is ensured that the toner image can be fixed to the recording medium 50, irrespective of the image forming mode.

Further, at a stage before the first heat roll 131 or the second heat roll 133 is in such a condition that it is able to apply sufficient heat to the recording medium 50, that is, during a warm-up, both heat rolls may be caused to generate heat. The warm-up time may be shortened in this case. Although one of the first heat roll 131 or the second heat roll 133 has been used to perform the transfer process as described above, both the first heat roll 131 and the second heat roll 133 may be used to heat the recording medium 50 when the recording medium 50 is thick paper. In this case, it is also ensured that the transfer process can be performed even though the recording medium 50 is thick paper.

As explained above, according to the embodiments, as the image forming apparatus of the intermediate transfer type is provided with the transfer portion in which the first transfer area for use in transferring the image on the image forming carrier to the intermediate transfer medium and the second transfer area for used in transferring the image on the intermediate transfer medium to the recording medium are set opposite to the image forming carrier and to the intermediate transfer medium, the primary transfer and the secondary transfer become realizable in such a form that one transfer portion is for common use.

Consequently, it becomes unnecessary to provide the secondary transfer portion separately from the first transfer portion outside the intermediate transfer medium with the adoption of the image forming method using the intermediate transfer medium, whereby it is possible to make achievable not only a reduction in the size and cost of but also space-saving for the image forming apparatus. In addition, images of good quality are obtainable stably.

Since the primary transfer and the secondary transfer are carried out with the one transfer portion for common use according to the invention, the monochromatic image forming apparatus can simply be graded up to the color-image forming apparatus in compliance with users' demands by making the basic unit for monochromatic image formation separable into the basic unit and the optional unit formed by adding the optional unit to the basic unit or replacing part of the basic unit with the optional unit.

What is claimed is:

1. An image forming apparatus comprising:

an image forming carrier;

an image forming portion that forms an image on the image forming carrier;

an intermediate transfer medium to which the image on the image forming carrier is primarily transferred; and a transfer portion that secondarily transfers to a recording medium the image primarily transferred to the intermediate transfer medium, wherein an area where the image forming carrier and the intermediate transfer medium touch each other includes a primary transfer bias application area where the image on the image forming carrier is transferred to the intermediate transfer medium and a secondary transfer bias application area where the image on the intermediate transfer medium is transferred to the recording medium, any one of the intermediate transfer medium and the image forming carrier is an endless belt, and a contact width of the image forming carrier with the intermediate transfer medium is equal to or longer than a perimeter of a tension roll having the smallest diameter among tensions rolls stretching the belt.

2. The image forming apparatus according to claim 1, wherein the transfer portion enables to perform in any one of an indirect transfer mode in which the image on the intermediate transfer medium is secondarily transferred to the recording medium and a direct transfer mode in which the image on the image forming carrier is directly transferred to the recording medium.

3. The image forming apparatus according to claim 2, further comprising:

a first reversing portion that inverts the recording medium before the recording medium passes through the primary transfer bias application area and the secondary transfer bias application area, wherein the first reversing portion inverts the recording medium in the indirect transfer mode.

4. The image forming apparatus according to claim 3, further comprising:

a second reversing portion that inverts the recording medium after the recording medium passes through the primary transfer bias application area and the secondary transfer bias application area, wherein the second reversing portion inverts the recording medium in the indirect transfer mode.

5. The image forming apparatus according to claim 3, further comprising:

a first fixing portion involving a heat roll which heats the recording medium and a pinch roll that rotatably holds the recording medium with the heat roll, wherein the image transferred to the recording medium is fixed to the recording medium by heat from the heat roll; and a third reversing portion that inverts the first fixing portion so that positions of the heat roll and the pinch roll with respect to a surface of the recording medium become inverted, wherein the third reversing portion inverts the first fixing portion so that an image transfer side of the recording medium abuts on the heat roll.

6. The image forming apparatus according to claim 2, further comprising:

a second fixing portion that fixes the image transferred to the recording medium to the recording medium by heat from the heat roll;

a guide portion that guides the recording medium, whose state is before that the transferred image is fixed, to the second fixing portion; and a guide direction switching portion that switches a direction of the guide portion toward the recording medium, wherein the guide direction switching portion directs the guide portion toward a side of the recording medium to which no image is transferred.

7. The image forming apparatus according to claim 2, further comprising:

a third fixing portion involving a first heat roll and a second heat roll which enable to heat the recording medium, wherein the first heat roll and the second heat roll rotatably hold the recording medium so that the image transferred to the recording medium is fixed to the recording medium by heat from the first heat roll or the second heat roll.

8. The image forming apparatus according to claim 7, wherein the third fixing portion fixes the image transferred to the recording medium to the recording medium by heat from a heat roll abutting on a side of the recording medium to which an image is transferred.

9. The image forming apparatus according to claim 7, wherein the third fixing portion causes the first heat roll and the second heat roll to generate heat during a warm-up.

10. The image forming apparatus according to claim 7, wherein the third fixing portion fixes the image to the recording medium by heat from the first heat roll and the second heat roll.

11. The image forming apparatus according to claim 1, wherein the belt has elasticity.

12. The image forming apparatus according to claim 1, wherein the transfer portion changes a transfer condition according to an image forming mode or type of the recording medium.

13. The image forming apparatus according to claim 12, wherein the image forming mode includes a monochromatic mode and a color mode, and in the monochromatic mode, the transfer portion directly transfers the image on the image forming carrier to the recording medium without primarily transferring to the intermediate transfer medium.

14. The image forming apparatus according to claim 1, wherein a primary transfer condition is different from a secondary transfer condition.

15. The image forming apparatus according to claim 14, wherein a primary transfer electric field is opposite in polarity to a secondary transfer electric field.

16. The image forming apparatus according to claim 14, wherein a first transfer speed in the primary transfer condition is different from a second transfer speed in the secondary transfer condition.

17. The image forming apparatus according to claim 1, wherein the image forming apparatus is separable to a basic unit for a monochromatic image formation and an optional unit provided by adding to the basic unit or replacing a part of the basic unit.

18. The image forming apparatus according to claim 17, wherein the basic unit involves the image forming carrier, the image forming portion and the transfer portion, the optional unit involves an optional sub-unit which enables to be provided by adding to the image forming portion and is required for a color image formation and an optional intermediate transfer medium which enables to be provided by adding between the image forming carrier and the transfer portion, and the transfer portion secondarily transfers to the recording medium the image transferred to the optional intermediate transfer medium after the image on the image forming carrier is primarily transferred to the optional intermediate transfer medium.

19. An image forming apparatus comprising:

an image forming carrier;

an image forming portion that forms an image on the image forming carrier;

an intermediate transfer medium to which the image on the image forming carrier is primarily transferred; and a transfer portion that secondarily transfers to a recording medium the image primarily transferred to the intermediate transfer medium, wherein an area where the image forming carrier and the intermediate transfer medium are opposed includes a primary transfer area where the image on the image forming carrier is transferred to the intermediate transfer medium and a secondary transfer area where the image on the intermediate transfer medium is transferred to the recording medium, the transfer portion, enables to perform in any one of an indirect transfer mode in which the image on the intermediate transfer medium is secondarily transferred to the recording medium and a direct transfer mode in which the image on the image forming carrier is directly transferred to the recording medium, any one of the intermediate transfer medium and the image forming carrier is an endless belt, and a contact width of the image forming carrier with the intermediate transfer medium is equal to or longer than a perimeter of a tension roll having the smallest diameter among tensions rolls stretching the belt.

20. An image forming apparatus comprising:

an image forming carrier;

an image forming portion that forms an image on the image forming carrier;

an intermediate transfer medium to which the image on the image forming carrier is primarily transferred; and a transfer portion that secondarily transfers to a recording medium the image primarily transferred to the intermediate transfer medium, wherein an area where the image forming carrier and the intermediate transfer medium are opposed includes a primary transfer area where the image on the image forming carrier is transferred to the intermediate transfer medium and a secondary transfer area where the image on the intermediate transfer medium is transferred to the recording medium, a primary transfer condition is different from a secondary transfer condition, and a first transfer speed in the primary transfer condition is different from a second transfer speed in the secondary transfer condition.

21. An image forming apparatus comprising:

an image forming carrier;

an image forming portion that forms an image on the image forming carrier;

an intermediate transfer medium to which the image on the image forming carrier is primarily transferred; and a transfer portion that secondarily transfers to a recording medium the image primarily transferred to the intermediate transfer medium, wherein an area where the image forming carrier and the intermediate transfer medium are opposed includes a primary transfer area where the image on the image forming carrier is transferred to the intermediate transfer medium and a secondary transfer area where the image on the intermediate transfer medium is transferred to the recording medium, and the image forming apparatus is separable to a basic unit for a monochromatic image formation and an optional unit provided by adding to the basic unit or replacing a part of the basic unit.

22. The image forming apparatus according to claim 21, wherein the basic unit involves the image forming carrier, the image forming portion and the transfer portion, the optional unit involves an optional sub-unit which enables to be provided by adding to the image forming portion and is required for a color image formation and an optional intermediate transfer medium which enables to be provided by adding between the image forming carrier and the transfer portion, and the transfer portion secondarily transfers to the recording medium the image transferred to the optional intermediate transfer medium after the image on the image forming carrier is primarily transferred to the optional intermediate transfer medium.

23. An image forming apparatus comprising:

an image forming carrier;

an image forming portion that forms an image on the image forming carrier;

an intermediate transfer medium to which the image on the image forming carrier is primarily transferred; and a transfer portion that secondarily transfers to a recording medium the image primarily transferred to the intermediate transfer medium, and a first reversing portion that inverts the recording medium before the recording medium passes through a primary transfer area and a secondary transfer area, wherein an area where the image forming carrier and the intermediate transfer medium are opposed includes the primary transfer area where the image on the image forming carrier is transferred to the intermediate transfer medium and the secondary transfer area where the image on the intermediate transfer medium is transferred to the recording medium, and the transfer portion enables to perform in any one of an indirect transfer mode in which the image on the intermediate transfer medium is secondarily transferred to the recording medium and a direct transfer mode in which the image on the image forming carrier is directly transferred to the recording medium, and the first reversing portion inverts the recording medium in the indirect transfer mode.

24. The image forming apparatus according to claim 23, further comprising:

a second reversing portion that inverts the recording medium after the recording medium passes through the primary transfer area and the secondary transfer area, wherein the second reversing portion inverts the recording medium in the indirect transfer mode.

25. The image forming apparatus according to claim 23, further comprising:

a first fixing portion involving a heat roll which heats the recording medium and a pinch roll that rotatably holds the recording medium with the heat roll, wherein the image transferred to the recording medium is fixed to the recording medium by heat from the heat roll; and a third reversing portion that inverts the first fixing portion so that positions of the heat roll and the pinch roll with respect to a surface of the recording medium become inverted, wherein the third reversing portion inverts the first fixing portion so that an image transfer side of the recording medium abuts on the heat roll.

26. An image forming apparatus comprising:

an image forming carrier;

an image forming portion that forms an image on the image forming carrier;

an intermediate transfer medium to which the image on the image forming carrier is primarily transferred; and a transfer portion that secondarily transfers to a recording medium the image primarily transferred to the intermediate transfer medium, a second fixing portion that fixes the image transferred to the recording medium by heat from the heat roll;

a guide portion that guides the recording medium, whose state is before that the transferred image is fixed, to the second fixing portion; and a guide direction switching portion that switches a direction of the guide portion toward the recording medium, wherein an area where the image forming carrier and the intermediate transfer medium are opposed includes a primary transfer area where the image on the image forming carrier is transferred to the intermediate transfer medium and a secondary transfer area where the image on the intermediate transfer medium is transferred to the recording medium, and the transfer portion enables to perform in any one of an indirect transfer mode in which the image on the intermediate transfer medium is secondarily transferred to the recording medium and a direct transfer mode in which the image on the image forming carrier is directly transferred to the recording medium, and the guide direction switching portion directs the guide portion toward a side of the recording medium to which no image is transferred.

27. An image forming apparatus comprising:

an image forming carrier;

an image forming portion that forms an image on the image forming carrier;

an intermediate transfer medium having an outer surface to which the image on the image forming carrier is primarily transferred; and a transfer portion contacting an interior surface of the intermediate transfer medium, the transfer portion including a primary transfer area contacting the interior surface of the intermediate transfer medium such that the primary transfer area applies a positive transfer bias to the transfer portion to enable image transfer from the image forming carrier to the outer surface of the intermediate transfer medium, and a secondary transfer area contacting the interior surface of the intermediate transfer medium such that the secondary transfer area applies a negative transfer bias to the transfer portion to enable image transfer from the outer surface of the intermediate transfer medium to a recording medium, wherein any one of the intermediate transfer medium and the image forming carrier is an endless belt, and a contact width of the image forming carrier with the intermediate transfer medium is equal to or longer than a perimeter of a tension roll having the smallest diameter among tensions rolls stretching the belt.

28. The image forming apparatus of claim 27, wherein the transfer portion is a transfer roll.

29. The image forming apparatus of claim 28, wherein the transfer roll is made of elastic conductive material.

30. The image forming apparatus of claim 29, wherein the elastic conductive material has a volume resistivity of about $10_6$ Ω*cm or less.

31. The image forming apparatus of claim 28, wherein the transfer roll has an outer diameter of between about 12 mm and 20 mm.

32. The image forming apparatus of claim 28, further comprising a power supply unit connected to the transfer roll such that the positive transfer bias or the negative transfer bias is selectively applied.

* * * * *